US009669291B1

(12) United States Patent
Holme et al.

(10) Patent No.: US 9,669,291 B1
(45) Date of Patent: Jun. 6, 2017

(54) SYSTEM AND METHOD TO FACILITATE MOVES IN A WORD GAME

(75) Inventors: Kevin Holme, Allen, TX (US); Michael Coker, San Francisco, CA (US); Jessica Oyhenart, Dallas, TX (US); Shannon Dees, San Francisco, CA (US); Daniel Hurd, Dallas, TX (US); Justin Rouse, Dallas, TX (US)

(73) Assignee: Zynga Inc., San Francisco, CA (US)

( * ) Notice: Subject to any disclaimer, the term of this patent is extended or adjusted under 35 U.S.C. 154(b) by 783 days.

(21) Appl. No.: 13/463,741

(22) Filed: May 3, 2012

Related U.S. Application Data

(60) Provisional application No. 61/491,771, filed on May 31, 2011.

(51) Int. Cl.
*A63F 3/04* (2006.01)
*G07F 17/32* (2006.01)

(52) U.S. Cl.
CPC ..... *A63F 3/04* (2013.01); *A63F 3/0423* (2013.01); *G07F 17/3295* (2013.01); *A63F 2003/0426* (2013.01); *A63F 2003/0428* (2013.01)

(58) Field of Classification Search
CPC ..... A63F 3/0423; A63F 2003/0426; A63F 2003/0428; A63F 3/04; G07F 17/3295
USPC ..... 463/9, 10
See application file for complete search history.

(56) References Cited

U.S. PATENT DOCUMENTS 4,201,389 A * 5/1980 Vowell ..... 273/272
6,364,766 B1 * 4/2002 Anderson et al. ..... 463/16
6,428,412 B1 * 8/2002 Anderson et al. ..... 463/9
6,650,952 B1 * 11/2003 Garcia et al. ..... 700/91
6,685,561 B2 * 2/2004 Anderson et al. ..... 463/16
7,112,135 B2 * 9/2006 Anderson et al. ..... 463/16
7,390,255 B2 * 6/2008 Walker ..... A63F 13/12 273/430
7,404,764 B2 * 7/2008 Bozeman ..... G07F 17/32 273/269
7,427,235 B2 * 9/2008 Anderson et al. ..... 463/16
7,601,059 B2 * 10/2009 Bozeman ..... 463/17
7,771,265 B2 * 8/2010 Perrie et al. ..... 463/18
8,235,800 B2 * 8/2012 Gingher ..... G07F 17/32 463/22
8,556,705 B2 * 10/2013 Gingher ..... G07F 17/32 463/22
9,061,211 B1 * 6/2015 Lohstroh ..... H04W 4/12
9,373,125 B2 * 6/2016 Chow ..... H04L 67/38
9,373,126 B2 * 6/2016 Chow ..... H04L 67/38
(Continued)

*Primary Examiner* — William H McCulloch, Jr.

(74) *Attorney, Agent, or Firm* — Schwegman Lundberg & Woessner, P.A.

(57) ABSTRACT

A system and method to facilitate moves in a word game includes a game asset distribution module that adjusts the respective distribution weights of letters in a set of alphabet letters. The letters are distributed to players in a word game with a probability proportional to the distribution weights. The game asset distribution module includes an analysis module to analyze the game board, lists of playable words, player skill levels, and relationships of particular letters in word formations. Accordingly, distribution weights of the letters are adjusted in order to facilitate allocation to the player of those letters which will facilitate word formation, ensure at least a minimum playable word experience, and enhance an overall user experience, even amongst players with significantly different skill levels.

17 Claims, 13 Drawing Sheets

(56) References Cited

U.S. PATENT DOCUMENTS

| | | | | |
|---|---|---|---|---|
| 9,373,127 | B2 * | 6/2016 | Chow | H04L 67/38 |
| 2003/0027616 | A1 * | 2/2003 | Vancura | 463/16 |
| 2005/0192087 | A1 * | 9/2005 | Friedman et al. | 463/25 |
| 2009/0280883 | A1 * | 11/2009 | Haveson | 463/9 |
| 2010/0279759 | A1 * | 11/2010 | Perrie et al. | 463/18 |
| 2012/0252557 | A1 * | 10/2012 | Chow et al. | 463/25 |
| 2012/0252559 | A1 * | 10/2012 | Chow et al. | 463/25 |
| 2012/0252573 | A1 * | 10/2012 | Chow et al. | 463/30 |
| 2012/0252574 | A1 * | 10/2012 | Chow et al. | 463/31 |
| 2015/0283464 | A1 * | 10/2015 | Lohstroh | H04W 4/12 463/29 |
| 2016/0307405 | A1 * | 10/2016 | Koll | G07F 17/3295 |
| 2016/0332068 | A1 * | 11/2016 | Ettridge | A63F 3/0421 |

* cited by examiner

SYSTEM AND METHOD TO FACILITATE MOVES IN A WORD GAME

CROSS-REFERENCE TO RELATED PATENT DOCUMENTS

This patent application claims a priority benefit of U.S. Provisional Patent Application No. 61/491,771; entitled "SYSTEM AND METHOD FOR FACILITATING MOVES IN A WORD GAME;" filed on May 31, 2011; which is incorporated herein by reference in its entirety.

TECHNICAL FIELD

This patent document pertains generally to data processing, and more particularly, but not by way of limitation, to facilitating moves in a word game.

BACKGROUND

Asynchronous games are designed to be played as a series of turns, in which each player performs one or more actions or one or more moves in a turn. In certain games, a turn may consist of the player attempting to perform a playable action from a set of game pieces. For example, in a word game, a player may try to form a word based on letters that the player has accumulated as game pieces. In another example, in a card game, the player may try to play a card from a hand of cards held by the player. There may be times when a player is unable to perform a playable action due to the fact that the player lacks the available pieces to perform a playable action or due to the fact that the player is unable to form a playable action from available pieces. In these and certain other situations, the enjoyment derived from playing a game is diminished, and the player may become frustrated with the game.

BRIEF DESCRIPTION OF DRAWINGS

Some embodiments are illustrated by way of example and not limitation in the figures of the accompanying drawings in which.

DETAILED DESCRIPTION

Figure 1:
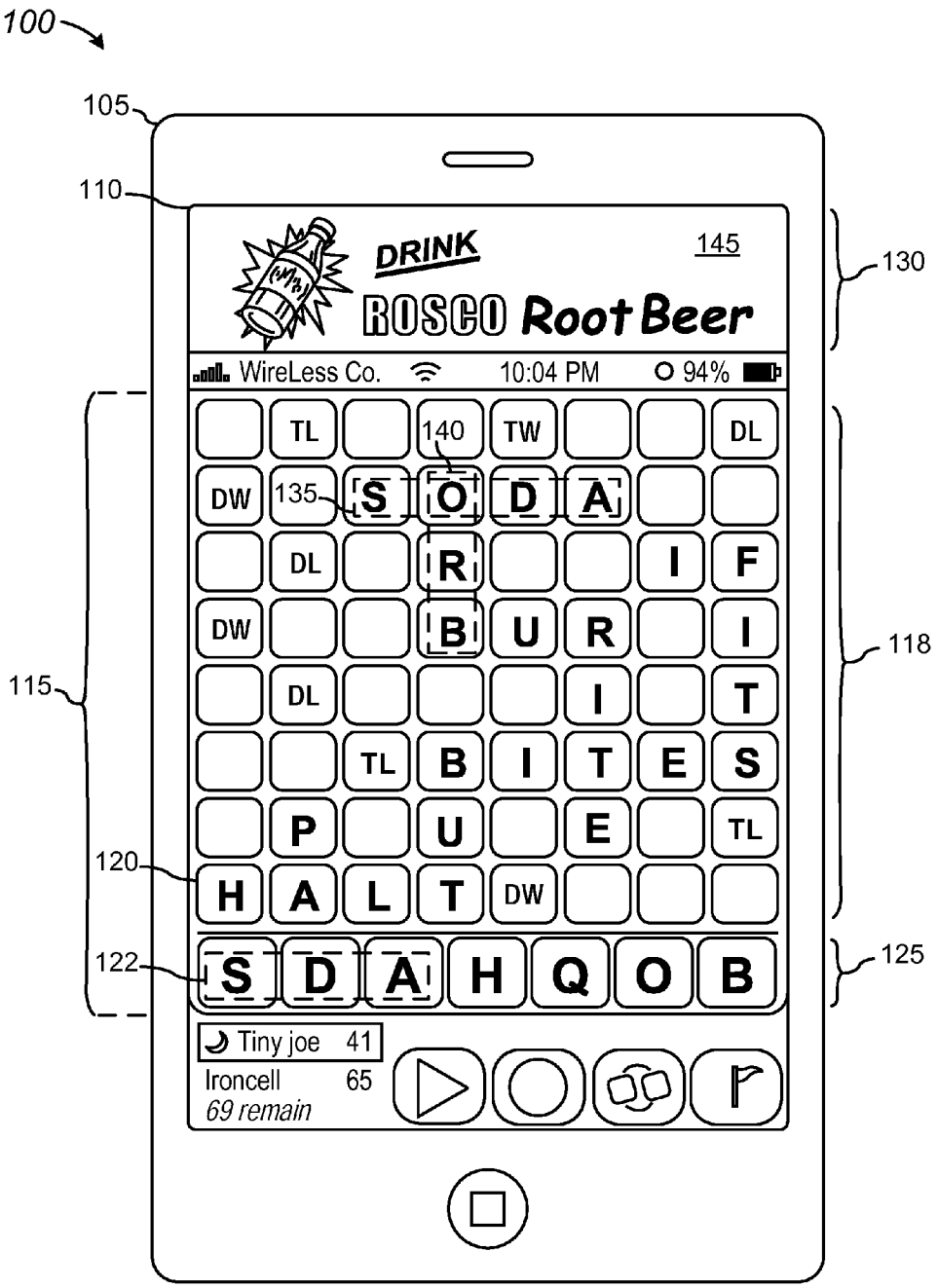
FIG. 1 is a device diagram illustrating a screen image of an advertisement displayed during game play on a mobile device, according to an example embodiment.

In the following description, for purposes of explanation, numerous specific details are set forth in order to provide a thorough understanding of some example embodiments. It will be evident, however, to one skilled in the art that the present invention may be practiced without these specific details.

In a system and method for distributing game assets in a social game, a game action is received from a player. The game action may comprise the formation of a word using at least one letter allocated to a player. Each letter of the alphabet may be weighted according to a weighting factor. At least one additional letter may be allocated to the player with a probability based on the respective distribution weight assigned to each alphabet letter.

In many games, there is a virtual world or some other imagined playing space where a player/user of the game controls one or more player characters (herein "character," "player character," or "PC"). Player characters may be considered in-game representations of the controlling player. As used herein, the terms "player," "user," "entity," and "friend" may refer to the in-game player character controlled by that player, user, entity, or friend, unless context suggests otherwise. The game display may display a representation of the player character. A game engine accepts inputs from the player, determines player character actions, decides outcomes of events and presents the player with a game display portraying the events that have transpired. In some games, there are multiple players, wherein each player controls one or more player characters.

In many computer games, there are various types of in-game assets (aka "rewards" or "loot") that a player character can obtain within the game. For example, a player character may acquire game points, gold coins, experience points, character levels, character attributes, virtual cash, game keys, or other in-game items of value. In many computer games, there are also various types of in-game obstacles that a player must overcome to advance within the game. In-game obstacles may include tasks, puzzles, opponents, levels, gates, and actions. In some games, a goal of the game may be to acquire certain in-game assets, which can then be used to complete in-game tasks or to overcome certain in-game obstacles. For example, a player may be able to acquire a virtual key (i.e., the in-game asset) that can then be used to open a virtual door (i.e., the in-game obstacle).

An electronic social networking system typically operates with one or more social networking servers providing interaction between users such that a user can specify other users of the social networking system as "friends," "contacts," or "connections" (hereinafter generally referred to as "friends"). A collection of users and the "friend" connections between users can form a social graph that can be traversed to find second, third and more remote connections between users, much like a graph of nodes connected by edges may be traversed.

Many online computer games are operated on an online social network. Such a network allows both users and other parties to interact with the computer games directly, whether to play the games or to retrieve game- or user-related information. Internet users may maintain one or more accounts with various service providers, including, for example, online game networking systems and online social networking systems. Online systems can typically be accessed using browser clients (e.g., Firefox®, Chrome®, and Internet Explorer®).

In many computer games, there are various types of in-game actions that a player character may make within the game. For example, a player character in an online role-playing game may be able to interact with other player characters, build a virtual house, attack enemies, go on a quest, go to a virtual store to buy/sell virtual items, etc. A player character in word game may be able to form a word from a set of letters, collect additional letters to form additional words, play a word game against another player character, and so forth.

Environment

FIG. 1 depicts a mobile device 100, such as a cell phone 105, engaged in an online game session as a client device. The mobile device 100 may serve as a physical platform to realize the playing space as described above. The mobile device 100 may incorporate a touch screen 110 to display images of game play and facilitate user interaction. A main game play area 115 may display a primary game play board area 118, which may be a word game for example, where words may be spelled out from letter tiles 120 available from a "tile rack" or "letter rack" 125. Each of two or more players (using different mobile devices or the same mobile device) may take turns spelling new words from their available letter tiles 122 where a new word includes at least one letter tile 120 associated with a previously played word to form the newly spelled word. A player may select a letter to play by applying a finger tip on the touch screen 110 over an available letter tile 120 in the tile rack 125. The letter tile 120 may then be dragged to an unoccupied tile position in the game play board area 118 while continuous contact is maintained with the finger on the touch screen 110.

In a user move, a succession of letter tiles 122 may be selected from the tile rack 125 and moved to a line of adjacent unoccupied tile positions to spell a complete word. Upon completion of spelling an entire word, an advertisement may be presented in an ad banner 130 in an upper portion of the touch screen 110. The content of the advertisement may be related to the user move.

In the present embodiment, a user has selected a succession of letters S-D-A 122 to spell the word "SODA" 135 horizontally across the beginning of the word "ORB" 140 in an upper portion of the touch screen 110. The word "SODA" 135 may be associated with an advertisement for a branded soft drink, such as the hypothetical "Rosco Root Beer" brand. Playing the user move S-D-A 122 to spell "SODA" 135 may cause the "Drink Rosco Root Beer" advertisement 145 to be displayed in the ad banner 130 at the mobile device 100. After a new word may be completely spelled out, a next player proceeds with their turn to try and spell another word.

The preceding embodiment of a word game may be an example of one type of game play involving a user move by a player that may involve the display of an advertisement associated with the user move. The advertisement may be associated with a most recent user move and have advertising content relating to the content or context of the user move. For example, spelling out the word "shirt" may cause the display of an advertisement for laundry detergent.

Embodiments of game play triggering related advertisements are not limited to a single user. Multiple users may be playing the same game and each user's game play may trigger separate advertisements which may be displayed at the respective mobile device 100 of each user. In other embodiments it may be possible that a general promotional advertisement may be displayed to one or more users to prompt a certain type of user moves on the part of users in game play which may in turn relate to a product being promoted.

System

Figure 2:
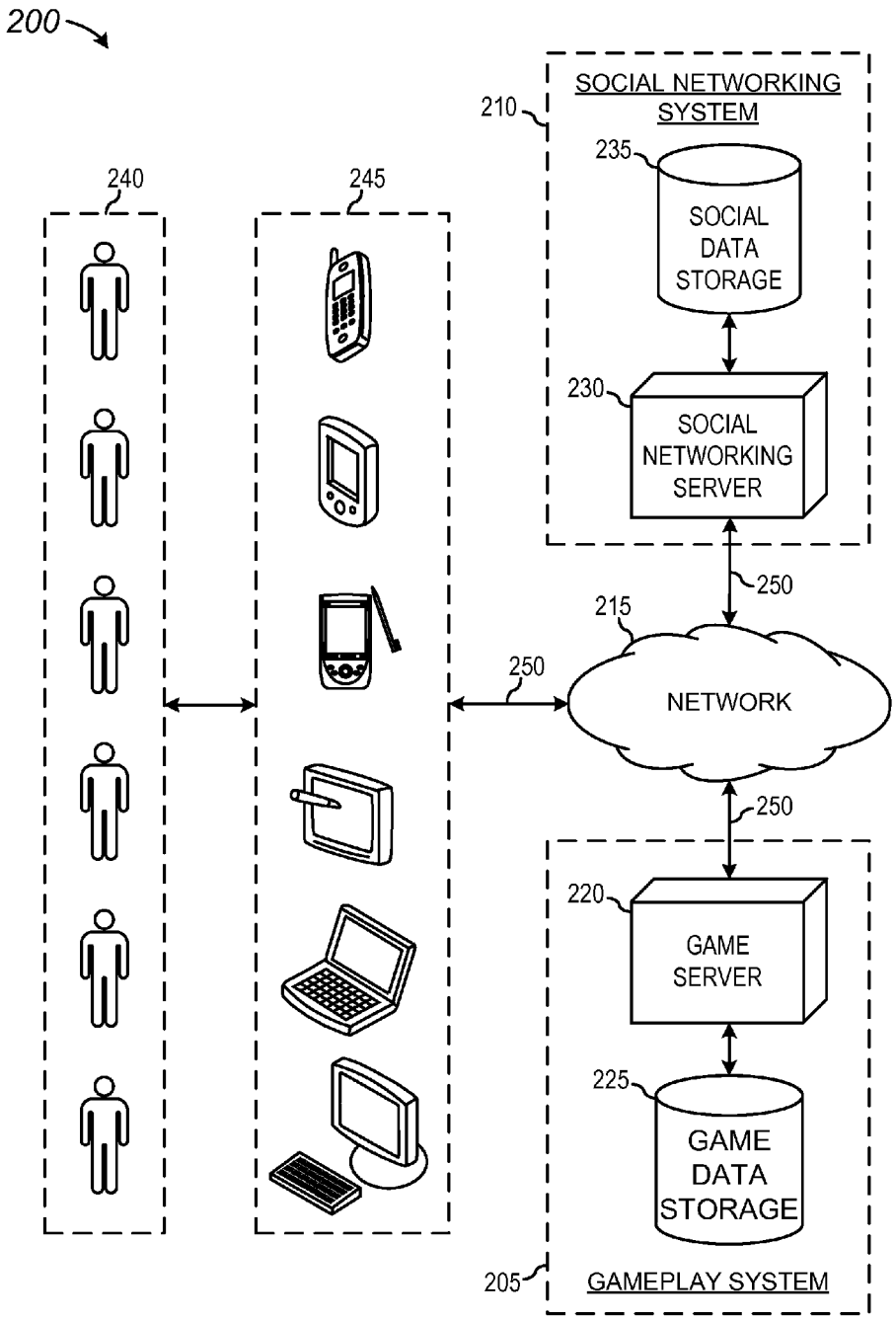
FIG. 2 is a block diagram representation of an online gaming system and social networking system, as may be used in some embodiments.

FIG. 2 depicts a gameplay environment 200 including a gameplay system 205 and a social networking system 210. The gameplay environment 200 is an example embodiment of an online network for gameplay between multiple users 240 utilizing various gameplay platform types 245 that may be facilitated by a network 215, such as the Internet for example. The gameplay system 205 may include a game server 220 and a game data storage 225. The gameplay system 205 maintains communication with the various gameplay platform types 245 of the multiple users 240 participating in multiple types of games as well as multiple "sessions" or "instances" of the same type of game. The gameplay system 205 may facilitate each gameplay session and manage transmissions between gameplay terminals during gaming sessions on the respective various gameplay platform types 245. The gameplay system 205 may maintain all details of gameplay actions as well as abbreviated indications of the gameplay interactions between users. Additionally, the gameplay system 205 mirrors gameplay input actions to the further users involved in each respective gaming session and maintains additional indications of interactions between multiple users 240 in order to support further progress in the games facilitated by the game server 220. An example of these additional interactions between users may be messaging between users during gameplay. All gameplay actions and related messaging may be stored on the game data storage 225.

The gameplay system 205 may be communicatively coupled through the network 215 and an Internet bus 250 to the social networking system 210. The social networking system 210 may include a social networking server 230 and social data storage 235. Each of the gameplay actions that the game server 220 is involved in and that may be stored in the game data storage 225 may also be communicated to the social networking server 230 and correspondingly stored in the social data storage 235. The storage of the gameplay indications (i.e., where indications may be abbreviations of complete gameplay actions) in the social data storage 235 may be thought of as constituting both a warehousing and mirroring of the totality of gameplay indications available to the game server 220. Based on this warehousing and mirroring of all gameplay indications, the social networking server 230 has a complete set of information with which to manage configuration of gameplay notifications to the multiple users 240 involved in all of the games.

A gameplay system 205 and the social networking system 210 may be communicatively coupled through the network 215 to multiple users 240. The multiple users 240 may be communicatively coupled through a particular device, selected from various gameplay platform types 245, to the network 215, the gameplay system 205 and the social networking system 210. The various gameplay platform types 245 may include a cell phone, a smart phone, a personal data assistant, an electronic tablet, a notebook computer, a desktop computer, a deskside computer, and a terminal, for example. Any particular one of the various gameplay platform types 245 may be used by the respective user for gameplay, gameplay notifications, or a combination of both gameplay and gameplay notifications. A particular user may have multiple of the various gameplay platform types 245 for any combination of gameplay input and gameplay notifications.

A typical game may involve, for example, at least two players taking successive turns at gameplay actions until one of the players wins the game. The game server 220 may serve multiple gaming applications to various sets of the multiple users 240. Any one of the multiple users 240 may be involved with several of the other multiple users 240 in multiple instances of the same game and in multiple types of games at the same time. The social networking server 230 receives indications of each move by each of the multiple users 240 in gameplay action.

A typical user of the multiple users 240 may not be able to be in continuous and concurrent attendance with another user of the same game during a gaming session. The typical user may desire to be informed about the completion of a pending move by another user. The typical user may also have multiple device types or platform types upon which the user may desire to have gameplay notifications communicated to. With the multitude of gaming sessions being played across multiple game types corresponding to each of the multiple users 240 there may be a critical demand created for a notification configuration within the social networking server 230.

The components of gameplay environment 200 may be connected to each other in any suitable configuration, using any suitable type of connection. The components may be connected directly or over a network 215, which may be any suitable network. For example, one or more portions of network 215 may be an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, another type of network, or a combination of two or more such networks.

Social networking system 210 is a network-addressable computing system that can host one or more social graphs. Social networking system 210 can generate, store, receive, and transmit social networking data. Social networking system 210 can be accessed by the other components of gameplay environment 200 either directly or via the network 215. The gameplay system 205 is a network-addressable computing system that can host one or more online games. The gameplay system 205 can generate, store, receive, and transmit game-related data, such as, for example, game account data, game input, game state data, and game displays. The gameplay system 205 may be accessed by the other components of gameplay environment 200 either directly or via the network 215. The multiple users 240 may use the various gameplay platform types 245 to access, send data to, and receive data from the social networking system 210 and the gameplay system 205. The various gameplay platform types 245 can access the social networking system 210 or the gameplay system 205 directly, via the network 215, or via a third-party system. As an example and not by way of limitation, the various gameplay platform types 245 may access the gameplay system 205 via the social networking system 210. The various gameplay platform types 245 can be any suitable computing device, such as a personal computer, a laptop, a cellular phone, a smart phone, a computing tablet, etc.

Although FIG. 2 illustrates a particular number as the number of multiple users 240, social networking systems 210, game networking systems 205, various gameplay platform types 245, and networks 215, this disclosure contemplates any suitable number as the number of multiple users 240, social networking systems 210, gameplay systems 205, gameplay platform types 245, and networks 215. As an example and not by way of limitation, the gameplay environment 200 may include one or more gameplay systems 205 and no social networking systems 210. As another example and not by way of limitation, gameplay environment 200 may include a system that comprises both the social networking system 210 and the gameplay system 205. Moreover, although FIG. 2 illustrates a particular arrangement of the various gameplay platform types 245, the social networking system 210, the gameplay system 205, the various gameplay platform types 245, and the network 215, this disclosure contemplates any suitable arrangement of the various gameplay platform types 245, the social networking system 210, the gameplay system 205, the various gameplay platform types 245, and the network 215.

The components of gameplay environment 200 may be connected to each other using any suitable connections 250. For example, suitable connections 250 include wireline (such as, for example, Digital Subscriber Line (DSL) or Data Over Cable Service Interface Specification (DOCSIS)), wireless (such as, for example, Wi-Fi or Worldwide Interoperability for Microwave Access (WiMAX)) or optical (such as, for example, Synchronous Optical Network (SONET) or Synchronous Digital Hierarchy (SDH)) connections. In particular embodiments, one or more connections 250 each include an ad hoc network, an intranet, an extranet, a VPN, a LAN, a WLAN, a WAN, a WWAN, a MAN, a portion of the Internet, a portion of the PSTN, a cellular telephone network, or another type of connection, or a combination of two or more such connections. The connections 250 need not necessarily be the same throughout the gameplay environment 200. One or more first connections 250 may differ in one or more respects from one or more second connections 250. Although FIG. 2 illustrates particular connections between the various gameplay platform types 245, the social networking system 210, the gameplay system 205, the various gameplay platform types 245, and the network 215, this disclosure contemplates any suitable connections between the various gameplay platform types 245, the social networking system 210, the gameplay system 205, the various gameplay platform types 245, and the network 215. As an example and not by way of limitation, in particular embodiments, the various gameplay platform types 245 may have a direct connection to the social networking system 210 or the gameplay system 205, bypassing the network 215.

Online Games and Game Networking Systems

In an online computer game, the game server 220 manages the game state of the game. The game state comprises all game play parameters, including player character state, non-player character (NPC) state, in-game object state, game world state (e.g., internal game clocks, game environment), and other game play parameters. Each the various gameplay platform types 245 controls one or more player characters (PCs). The game engine controls all other aspects of the game including non-player characters (NPCs) and in-game objects. The game engine also manages game state, including player character state for currently active (online) and inactive (offline) players.

An online game may be hosted by the gameplay system 205, which may be accessed using any suitable connection with a suitable gameplay platform type 245. A player may have a game account on the gameplay system 205, wherein the game account can contain a variety of information associated with the player (e.g., the player's personal information, financial information, purchase history, player character state, and game state). In some embodiments, a player may play multiple games on the gameplay system 205, which may maintain a single game account for the player with respect to all the games, or multiple individual game accounts for each game with respect to the player. In some embodiments, the gameplay system 205 can assign a unique identifier to each the various gameplay platform types 245 of an online game hosted on the gameplay system 205. Gameplay system 205 can determine that a the various gameplay platform types 245 is accessing the online game by reading the user's cookies, which may be appended to HTTP requests transmitted by the various gameplay platform types 245, and/or by the multiple users 240 logging onto the online game.

In particular embodiments, the various gameplay platform types 245 may access an online game and control the game's progress via the various gameplay platform types 245 (e.g., by inputting commands to the game at the client device). The various gameplay platform types 245 may display the game interface, receive inputs from the various gameplay platform types 245, transmitting user inputs or other events to the game engine, and receive instructions from the game engine. The game engine may be executed on any suitable system (such as, for example, the various gameplay platform types 245, the social networking system 210, or the gameplay system 205). As an example and not by way of limitation, the various gameplay platform types 245 can download client components of an online game, which are executed locally, while a remote game server, such as the gameplay system 205, provides backend support for the client components and may be responsible for maintaining application data of the game, processing the inputs from the player, updating and/or synchronizing the game state based on the game logic and each input from the player, and transmitting instructions to the various gameplay platform types 245. As another example and not by way of limitation, each time the various gameplay platform types 245 provides an input to the game through the various gameplay platform types 245 (such as, for example, by typing on the keyboard or clicking the mouse of the various gameplay platform types 245), the client components of the game may transmit the player's input to the gameplay system 205.

Game Systems, Social Networks, and Social Graphs

In an online multiplayer game, players may control player characters (PCs), while a game engine may control non-player characters (NPCs) and game features. The game engine also may manage player character state and game state and may track the state for currently active (i.e., online) players and currently inactive (i.e., offline) players. A player character may have a set of attributes and a set of friends associated with the player character. As used herein, the term "player character state" can refer to any in-game characteristic of a player character, such as location, assets, levels, condition, health, status, inventory, skill set, name, orientation, affiliation, specialty, and so on. Player characters may be displayed as graphical avatars within a user interface of the game. In other implementations, no avatar or other graphical representation of the player character is displayed. Game state encompasses the notion of player character state and refers to any parameter value that characterizes the state of an in-game element, such as a non-player character, a virtual object (such as a wall or castle), etc. The game engine may use player character state to determine the outcome of game events, sometimes also considering set or random variables. Generally, a player character's probability of having a more favorable outcome is greater when the player character has a better state. For example, a healthier player character is less likely to die in a particular encounter relative to a weaker player character or non-player character. In some embodiments, the game engine can assign a unique client identifier to each player.

In particular embodiments, the various gameplay platform types 245 may access particular game instances of an online game. A game instance is copy of a specific game play area that is created during runtime. In particular embodiments, a game instance is a discrete game play area where multiple users 240 can interact in synchronous or asynchronous play. A game instance may be, for example, a level, zone, area, region, location, virtual space, a game board, a game lobby, or other suitable play area. A game instance may be populated by one or more in-game objects. Each object may be defined within the game instance by one or more variables, such as, for example, position, height, width, depth, direction, time, duration, speed, color, and other suitable variables. A game instance may be exclusive (i.e., accessible by specific players) or nonexclusive (i.e., accessible by any player). In particular embodiments, a game instance is populated by one or more player characters or in-game objects controlled by multiple users 240 and/or one or more in-game objects controlled by the game engine. When accessing an online game, the game engine may allow the various gameplay platform types 245 to select a particular game instance to play from a plurality of game instances. Alternatively, the game engine may automatically select the game instance that the various gameplay platform types 245 will access. In particular embodiments, an online game comprises only one game instance that all the multiple users 240 of the online game can access.

In particular embodiments, a specific game instance may be associated with one or more specific players. A game instance is associated with a specific player when one or more game parameters of the game instance are associated with the specific player. As an example and not by way of limitation, a game instance associated with a first player may be named "First Player's Play Area." This game instance may be populated with the first player's PC and one or more in-game objects associated with the first player. In particular embodiments, a game instance associated with a specific player may only be accessible by that specific player. As an example and not by way of limitation, a first player may access a first game instance when playing an online game and this first game instance may be inaccessible to all other players. In other embodiments, a game instance associated with a specific player may be accessible by one or more other players, either synchronously or asynchronously with the specific player's game play. As an example and not by way of limitation, a first player may be associated with a first game instance, but the first game instance may be accessed by all first-degree friends in the first player's social network. In particular embodiments, the game engine may create a specific game instance for a specific player when that player accesses the game. As an example and not by way of limitation, the game engine may create a first game instance when a first player initially accesses an online game, and that same game instance may be loaded each time the first player accesses the game. As another example and not by way of limitation, the game engine may create a new game instance each time a first player accesses an online game, wherein each game instance may be created randomly or selected from a set of predetermined game instances. In particular embodiments, the set of in-game actions available to a specific player may be different in a game instance that is associated with that player compared to a game instance that is not associated with that player. The set of in-game actions available to a specific player in a game instance associated with that player may be a subset, superset, or independent of the set of in-game actions available to that player in a game instance that is not associated with him. As an example and not by way of limitation, a first player may be associated with Blackacre Farm in an online farming game. The first player may be able to plant crops on Blackacre Farm. If the first player accesses game instance associated with another player, such as Whiteacre Farm, the game engine may not allow the first player to plant crops in that game instance. However, other in-game actions may be available to the first player, such as watering or fertilizing crops on Whiteacre Farm.

In particular embodiments, a game engine can interface with a social graph. Social graphs are models of connections between entities (e.g., individuals, users, contacts, friends, players, player characters, non-player characters, businesses, groups, associations, concepts, etc.). These entities are considered "users" of the social graph; as such, the terms "entity" and "user" may be used interchangeably when referring to social graphs herein. A social graph can have a node for each entity and edges to represent relationships between entities. A node in a social graph can represent any entity. In particular embodiments, a unique client identifier can be assigned to each user in the social graph. This disclosure assumes that at least one entity of a social graph is a player or player character in an online multiplayer game, though this disclosure contemplates any suitable social graph users.

The minimum number of edges required to connect a player (or player character) to another user is considered the degree of separation between them. For example, where the player and the user are directly connected (one edge), they are deemed to be separated by one degree of separation. The user would be a so-called "first-degree friend" of the player. Where the player and the user are connected through one other user (two edges), they are deemed to be separated by two degrees of separation. This user would be a so-called "second-degree friend" of the player. Where the player and the user are connected through N edges (or N−1 other users), they are deemed to be separated by N degrees of separation. This user would be a so-called "Nth-degree friend." As used herein, the term "friend" means only first-degree friends, unless context suggests otherwise.

Within the social graph, each player (or player character) has a social network. A player's social network includes all users in the social graph within Nmax degrees of the player, where Nmax is the maximum degree of separation allowed by the system managing the social graph (such as, for example, the social networking system 210 or the gameplay system 205). In one embodiment, Nmax equals 1, such that the player's social network includes only first-degree friends. In another embodiment, Nmax is unlimited and the player's social network is coextensive with the social graph.

In particular embodiments, the social graph is managed by the gameplay system 205, which is managed by the game operator. In other embodiments, the social graph is part of the social networking system 210 managed by a third-party (e.g., Facebook®, Friendster®, Myspace®). In yet other embodiments, the various gameplay platform types 245 has a social network on both the gameplay system 205 and the social networking system 210, wherein the various gameplay platform types 245 can have a social network on the gameplay system 205 that is a subset, superset, or independent of the player's social network on the social networking system 210. In such combined systems, the gameplay system 205 can maintain social graph information with edge type attributes that indicate whether a given friend is an "in-game friend," an "out-of-game friend," or both. The various embodiments disclosed herein are operable when the social graph is managed by the social networking system 210, the gameplay system 205, or both.

Figure 3:
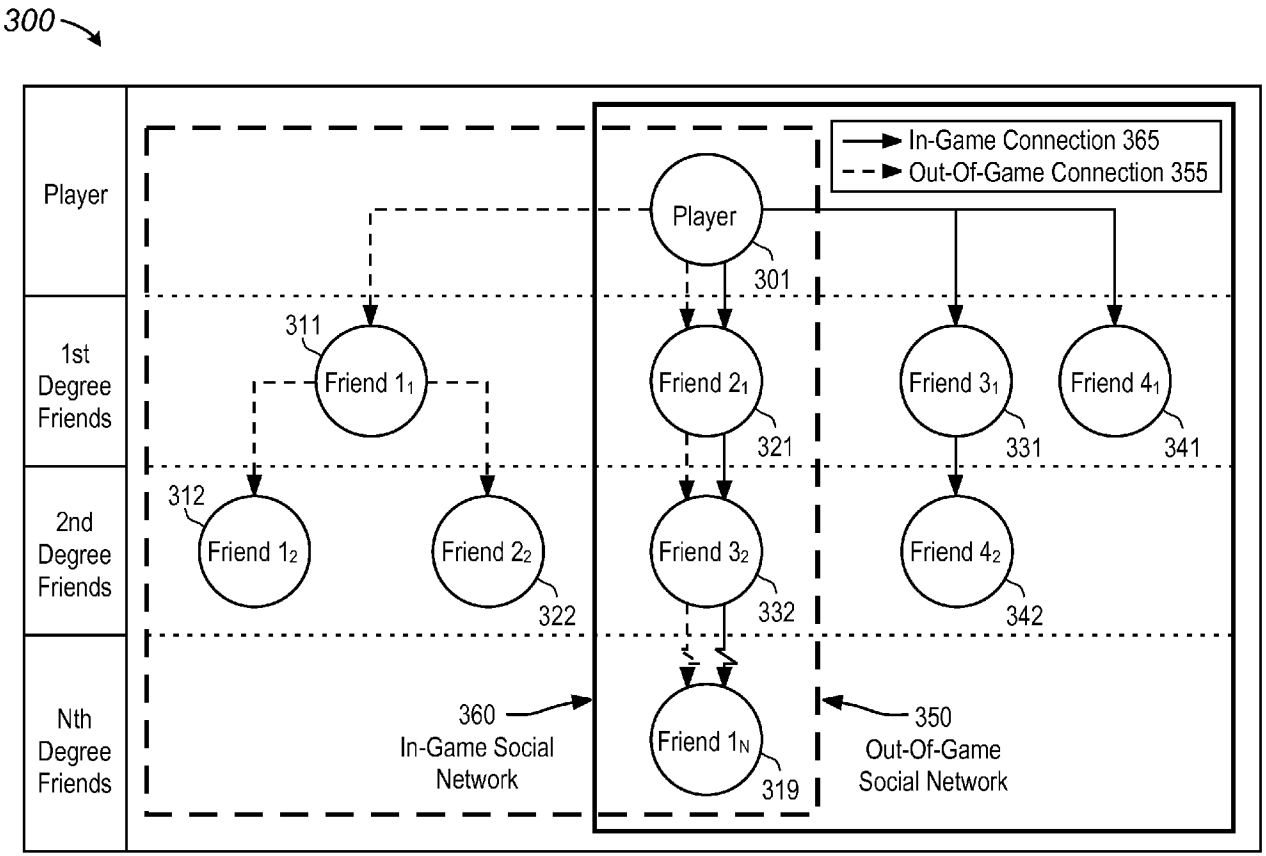
FIG. 3 is a block diagram illustrating an example of a social network within a social graph, according to some embodiments.

FIG. 3 is a block diagram illustrating an example of an out-of-game social network 350 within a social graph. As shown, a Player 301 can be associated, connected or linked to various other users, or "friends," within the out-of-game social network 350. These associations, connections or links can track relationships between users within the out-of-game social network 350 and are commonly referred to as online "friends" or "friendships" between users. Each friend or friendship in a particular user's social network within a social graph is commonly referred to as a "node." For purposes of illustration and not by way of limitation, the details of out-of-game social network 350 will be described in relation to the Player 301. As used herein, the terms "player" and "user" can be used interchangeably and can refer to any user or character in an online multiuser game system or social networking system. As used herein, the term "friend" can mean any node within a player's social network.

As shown in FIG. 3, the Player 301 has direct connections with several friends. When the Player 301 has a direct connection with another individual, that connection is referred to as a first-degree friend. In out-of-game social network 350, the Player 301 has two first-degree friends. That is, the Player 301 is directly connected to Friend $\mathbf{1}_1$ 311 and Friend $\mathbf{2}_1$ 321. In a social graph, it is possible for individuals to be connected to other individuals through their first-degree friends (i.e., friends of friends). As described above, each edge required to connect a player to another user is considered the degree of separation. For example, FIG. 3 shows that the Player 301 has three second-degree friends to which he is connected via his connection to his first-degree friends. Second-degree Friend $\mathbf{1}_2$ 312 and Friend $\mathbf{2}_2$ 322 are connected to the Player 301 via his first-degree Friend $\mathbf{1}_1$ 311. The limit on the depth of friend connections, or the number of degrees of separation for associations, that the Player 301 is allowed is typically dictated by the restrictions and policies implemented by the social networking system 210.

In various embodiments, the Player 301 can have Nth-degree friends connected to him through a chain of intermediary degree friends as indicated in FIG. 3. For example, Nth-degree Friend $\mathbf{1}_N$ 319 is connected to the Player 301 via second-degree Friend $\mathbf{3}_2$ 332 and one or more other higher-degree friends. Various embodiments may take advantage of and utilize the distinction between the various degrees of friendship relative to the Player 301.

In particular embodiments, a player (or player character) can have a social graph within an online multiplayer game that is maintained by the game engine and another social graph maintained by a separate social networking system. FIG. 3 depicts an example of in-game social network 360 and out-of-game social network 350. In this example, the Player 301 has out-of-game connections 355 to a plurality of friends, forming out-of-game social network 350. Here, Friend $\mathbf{1}_1$ 311 and Friend $\mathbf{2}_1$ 321 are first-degree friends with the Player 301 in his out-of-game social network 350. The Player 301 also has in-game connections 365 to a plurality of players, forming in-game social network 360. Here, Friend $\mathbf{2}_1$ 321, Friend $\mathbf{3}_1$ 331, and Friend $\mathbf{4}_1$ 341 are first-degree friends within the Player's 301 in-game social network 360. In some embodiments, it is possible for a friend to be in both the out-of-game social network 350 and the in-game social network 360. Here, Friend $\mathbf{2}_1$ 321 has both an out-of-game connection 355 and an in-game connection 365 with the Player 301, such that Friend $\mathbf{2}_1$ 321 is in both the Player's 301 in-game social network 360 and the Player's 301 out-of-game social network 350.

As with other social networks, the Player 301 can have second-degree and higher-degree friends in both his in-game and out of game social networks. In some embodiments, it is possible for the Player 301 to have a friend connected to him both in his in-game and out-of-game social networks, wherein the friend is at different degrees of separation in each network. For example, if Friend $\mathbf{2}_2$ 322 had a direct in-game connection with the Player 301, Friend $\mathbf{2}_2$ 322 would be a second-degree friend in the Player's 301 out-of-game social network, but a first-degree friend in the Player's 301 in-game social network. In particular embodiments, a game engine can access in-game social network 360, out-of-game social network 350, or both.

In particular embodiments, the connections in a player's in-game social network can be formed both explicitly (e.g., users must "friend" each other) and implicitly (e.g., system observes user behaviors and "friends" users to each other). Unless otherwise indicated, reference to a friend connection between two or more players can be interpreted to cover both explicit and implicit connections, using one or more social graphs and other factors to infer friend connections. The friend connections can be unidirectional or bidirectional. It is also not a limitation of this description that two players who are deemed "friends" for the purposes of this disclosure are not friends in real life (i.e., in disintermediated interactions or the like), but that could be the case.

Game Systems

A game event may be an outcome of a user action, an engagement, a provision of access, rights and/or benefits, or the obtaining of some assets (e.g., health, money, strength, inventory, land, etc.). A game engine determines the outcome of a game event according to a variety of factors, such as the game rules, a player character's in-game actions, player character state, game state, interactions of other player characters, and random calculations. Engagements can include simple tasks (e.g., plant a crop, clean a stove), complex tasks (e.g., build a farm or business, run a café), or other events.

An online game can be hosted by the gameplay system 205, which can be accessed over any suitable connections 250 with any appropriate gameplay platform types 245. A player may have a game system account on the gameplay system 205, wherein the game system account can contain a variety of information about the player (e.g., the player's personal information, player character state, game state, etc.). In various embodiments, an online game can be embedded into a third-party website. The game can be hosted by the networking system of the third-party website, or it can be hosted on the gameplay system 205 and merely accessed via the third-party website. The embedded online game can be hosted solely on the game server 220 or using a third-party vendor server. In addition, any combination of the functions of the present disclosure can be hosted on or provided from any number of distributed network resources. For example, one or more executable code objects that implement all or a portion of the game can be downloaded to a client system for execution.

Virtual Currency

In various embodiments, players within the game can acquire virtual currency. In such games, the virtual currency might be represented by virtual coins, virtual cash, or by a number or value stored by the server for that player's benefit. Such virtual currency represents units of value for use in the online game system, and is analogous to legal currency. Virtual currency can be purchased in one or more actual cash or credit transactions by a player, where the legal currency is transferred using a credit/debit/charge card transaction conveyed over a financial network. In some embodiments, a player may earn virtual currency by taking action in the game. For example, a player may be rewarded with one or more units of virtual currency after completing a task, quest, level, challenge, or mission within the game. For example, a farming game might reward 10 gold coins each time a virtual crop is harvested.

In some embodiments, virtual currency can be used to purchase one or more in-game assets or other benefits. For example, a player may be able to exchange virtual currency for a desired level, access, right, or item in an online game. In one embodiment, legal currency can be used to directly purchase an in-game asset or other benefit. The player can select the desired in-game asset or other benefit. Once the necessary selections are made, the player can place the order to purchase the in-game asset or other benefit. This order is received by the gameplay system 205, which can then process the order. If the order is processed successfully, an appropriate financial account associated with the player can be debited by the amount of virtual currency or legal currency needed to buy the selected in-game asset or other benefit.

In some embodiments, multiple types of virtual currency may be available for purchase from the game system operator. For example, an online game may have virtual gold coins and virtual cash. The different types of virtual currency may have different exchange rates with respect to legal currency and each other. For example, a player may be able to exchange $1 in legal currency for either 100 virtual gold coins or $2 in virtual cash, but virtual gold coins may not be exchanged for virtual cash. Similarly, where in-game assets and other benefits can be purchased with virtual currency, they may have different exchange rates with respect to the different types of virtual currency. For example, a player may be able to buy a virtual business object for $10 in virtual cash, but may not purchase the virtual business object for virtual gold coins alone. In some embodiments, certain types of virtual currency can be acquired by engaging in various in-game actions while other types of virtual currency can only be acquired by exchanging legal currency. For example, a player may be able to acquire virtual gold coins by selling virtual goods in a business, but can only acquire virtual cash by exchanging legal currency. In some implementations, virtual cash may also be awarded for leveling up in the game.

Distribution of Game Assets

Figure 4:
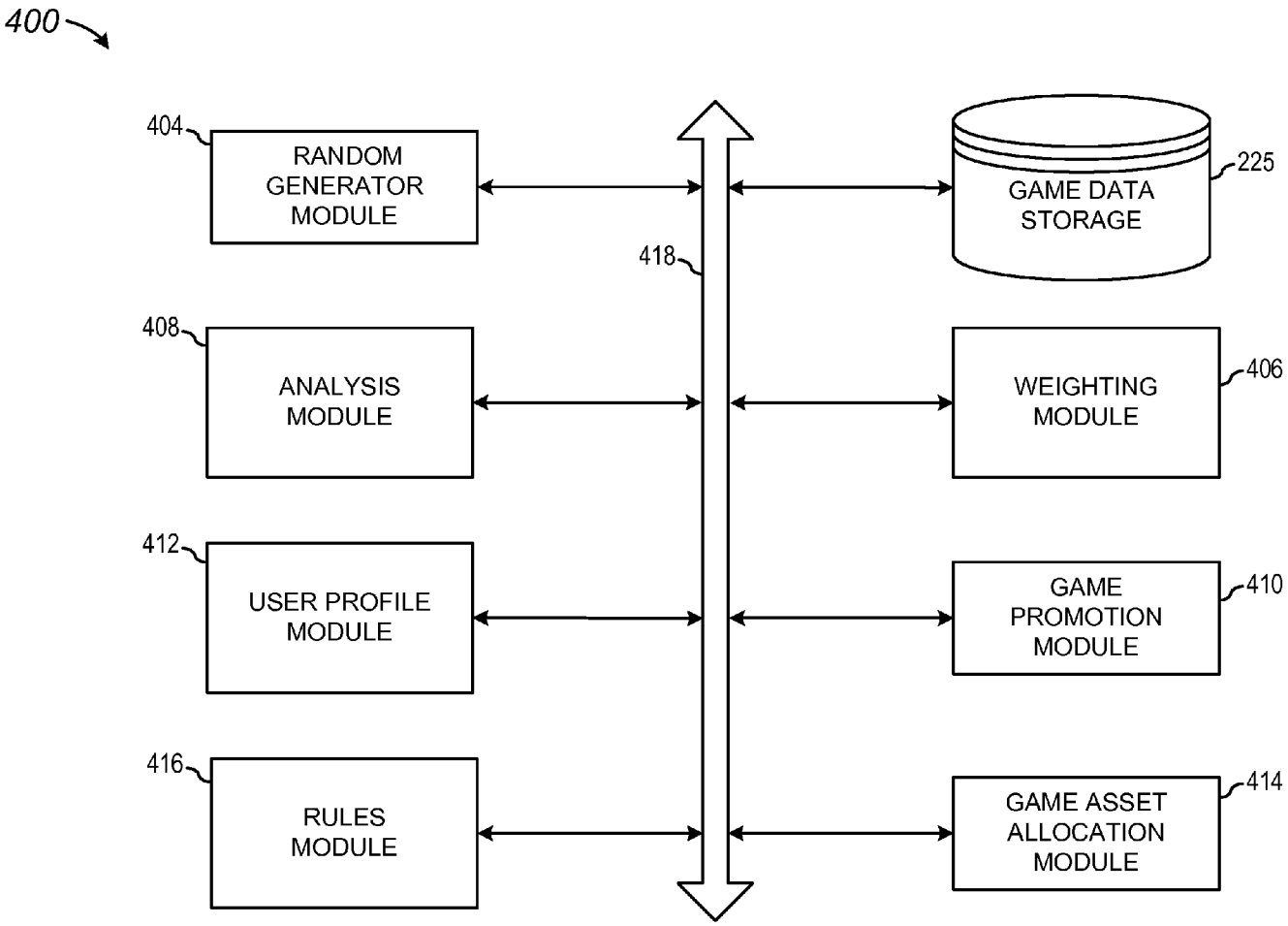
FIG. 4 is a block diagram illustrating example modules of a gameplay system to distribute game assets, as may be used in some embodiments.

FIG. 4 is a block diagram illustrating example modules of the gameplay system 205 related to distributing game assets in a social game. In some embodiments, the social game may be a word game in which players form words from one or more letters. Each word may be assigned a score depending on the letters used to form the word. Game assets may include the letters distributed to each player that are used to form words.

In certain word games, the player builds words and compares them against a dictionary of possible valid entries. Game assets, such as game tiles, featuring letters from the alphabet, are associated with points (which, in turn, is associated with the relative difficulty of using the particular letter in a word), and these tiles are drawn from a "bag", which is finite and can be depleted. In other word games, the letter bag is infinite and cannot be depleted, which has its own implications about the frequency or probability of discrete letter draws and the ability of the player to form words with these tiles. In both cases, a system and method have been designed that can help create allowable moves while simultaneously reducing the amount of minimally-playable states.

An example of a minimally-playable state may occur in word games, and a player may be given letters with which they cannot make a meaningful play. The player may be forced to "pass" on that particular round of game action and end up having to wait for the next player(s) to make a move. An additional risk is that a player with a relatively high number of difficult to use tiles (e.g., high-point letters) may resort to playing words which they do not know the definitions of. This may also be frustrating for the other player, as they may be receiving words in gameplay that are not in common in everyday usage, and which neither player can define.

Ideally, the users have a larger subset of easily-usable letter tiles so that they have a wider potential vocabulary from which to pull. However, accomplishing this objective requires balancing optimal tile-draws without upsetting the overall balance of gameplay.

The gameplay system 205 includes a game asset distribution module 400 that is configured to distribute game assets in a social game. The game asset distribution module 400, in turn, includes various modules 404-416. A random generator module 404 is configured to generate random distributions of game assets to a user. The random generator module 404 may operate similarly to a person's stirring up of game tiles in a draw bag prior to drawing a letter. A weighting module 406 is configured to weight and adjust the weighting of assets to be distributed to a user. The weighting module 406 assigns to each game asset a respective "weight" or "distribution weight" affecting a corresponding distribution of each game asset. The weighting module 406 may receive input from an analysis module 408, a game promotion module 410, a game asset allocation module 414, and a rules module 416 (each discussed below). For example, the weighting module 406 may receive input from the game asset allocation module 414 when a determination has been made that certain game assets (e.g., letters) should be weighted with an adjusted distribution weights that cause certain assets to be allocated to a user more frequently than would be the case with the assets having prior distribution weights. Based on the input from the game asset allocation module 414 the weighting module 406 may adjust distribution weights of certain of the alphabet letters being allocated to all or certain ones of the players in a game. The rules module 416 may provide input in a similar way according to portrayal of particular sets of rules.

The analysis module 408 is configured to analyze game actions to determine which game assets are used more frequently and in what situations and in response to what stimuli game assets are used. The analysis module 408 may determine how to adjust a distribution of weights across a set of alphabet letters or adjust a weight of a particular letter to better conform to a gameplay rule or objective. The analysis module 408 may be continually apprised of the gameplay rules and objectives by the rules module 416. The analysis module 408 may collect information about playable situations on the game board, assess letters available for play from both a draw bag and from players' tile racks, and compare those inputs with the rules and objectives of the game to determine real-time updates that may be important to the weighting module 406.

The game promotion module 410 is configured to determine whether a game promotional campaign is to be implemented and if so, to vary the weighting of game assets in a manner that incentivizes a user to participate in the game promotional campaign. For instance, a client may sponsor an ad campaign to promote a soft drink. A promotional word associated with the campaign may be the words "root beer." The game promotion module 410 may provide input to the weighting module 406 to adjust the respective weights (or "distribution weights") of the letters occurring in the words "root beer." The respective weights of letters in the words "root beer" may be adjusted slightly higher than their normal occurring weights in a regular alphabet letter distribution or prior distribution weights in a particular state at gameplay so that a typical user may have a slightly greater access to them. This heightened access to these letters may enhance any player's likelihood of playing the words in a game action and participating in the campaign. Each player may still have to form the promotional word in a game action on their own recognizance. The heightened access to particular letters initiated by the game promotion module 410, along with advertisements or promotional information available to the player, may help to spur the particular game action on the part of a given player for playing words featured in a promotional campaign.

A user profile module 412 is configured to access a user profile of a given user and may use any game history and other user profile factors available in the user's profile as input in determining a weighting distribution of game assets to the user. For instance, in perusing the game history of a given user the user profile module 412 may determine that the user has been winning a significant percentage of the games they have engaged in recently. A total number of wins or a high percentage of wins may determine a skill level for the user above a predetermined threshold. The user's skill level being determined this way as a relatively high skill level may mean that the user profile module 412 may operate in combination with the analysis module 408, for instance, to determine a particular weighting distribution of game assets. For example, the distribution weight of the player's letters to be drawn in further game actions may be increased for high-point alphabet letters and decreased for low-point alphabet letters. The high-point alphabet letters are generally more difficult to play in the low-point alphabet letters are generally easier to play than some hypothetical nominal letter of the alphabet. The relatively highly skilled player may then receive more letters that are difficult to play and fewer letters that are easy to play. In this way a user with a relatively high skill level may be moderated to have a chance of winning that is more in keeping with other players in the same game having a lower skill level.

The game asset allocation module 414 is configured to account for the various weighting factors and determine which game assets should be distributed to the user. When various rules and objectives of a game are simultaneously vying for influence of distribution and weighting of game assets the game asset allocation module 414 may become involved to determine the allocation of assets to a particular player on a given move. When a promotional campaign may be underway, a game enters the latter stages of gameplay, an analysis of words having been played is underway, and a losing player has been identified, the game asset allocation module 415 may determine which assets are to be allocated to a given player in consideration of multiple rules, game objectives, and game states that may be operative through the various modules 404-416. In this way, the asset allocation module may work, and possibly in conjunction with the rules module 416, to develop a cohesive application of the sum-total of rules, objectives, and conditions in gameplay in determining asset allocations.

The rules module 416 is configured to manage and apply sets of rules used in implementing game-based directives and objectives affecting weighting and distribution of game assets. Many of the basic principles in application of rules and the implementation of gameplay objectives described here may be readily adapted to many languages other than English. The rules module 416 may be utilized to accommodate gameplay with different languages by changing the contents of the rules but may still utilize the same gaming framework.

For instance, when two or more letters commonly occur in relationship within certain word formations, the rules that may be involved in one language may be modified to accommodate two or more different letters having a similar occurrence relationship in a different language. Straightforward modification to particular letters applied in a given rule by the rules module 416 may be readily extended to another language with a simple change of letters corresponding to the other language. In this way, the same gameplay system 205 may be utilized with the same rules module 416 to accommodate a different language by incorporating straightforward changes to the rules. The analysis module 408 may also be used in conjunction with the rules module 416 to effect use of the gameplay system 205 with the new language.

The game data storage 225 retains gameplay actions, game state, game play parameters in-game object states, and game world state. The modules 404-416 are communicatively coupled to one another and to the game server 220 through an interconnect bus 418.

Each of the modules discussed with reference to FIG. 4 will be explained in further detail in accordance with the example methods disclosed herein.

Data Flow

Figure 5:
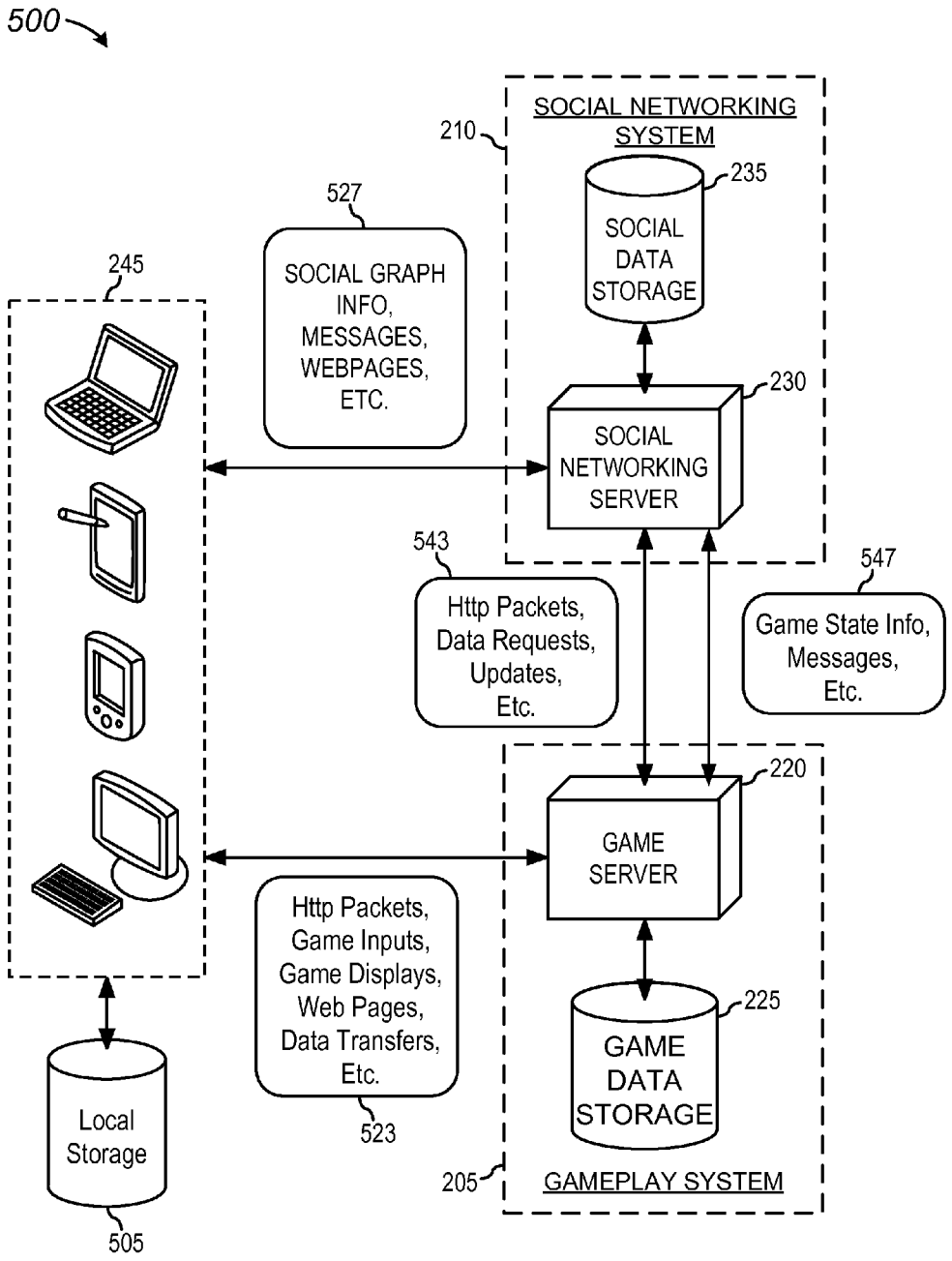
FIG. 5 is a block diagram illustrating an example data flow between the components of a gameplay system, as may be used in an example embodiment.

FIG. 5 is a block diagram illustrating an example data flow between the components of a gaming environment 500. In particular embodiments, the gaming environment 500 can include various gameplay platform types 245, the social networking system 210, and the gameplay system 205. The components of the gaming environment 500 can be connected to each other in any suitable configuration, using any suitable type of connection. The components may be connected directly or over any suitable network. The various gameplay platform types 245, the social networking system 210, and the gameplay system 205 can each have one or more corresponding data stores such as a local storage 505, social data storage 235, and game data storage 225, respectively. The social networking system 210 and the gameplay system 205 can also have one or more servers that can communicate with the various gameplay platform types 245 over an appropriate network. The social networking system 210 and the gameplay system 205 can have one or more internet servers such as the game server 220 and the social networking server 230, for example, for communicating with the various gameplay platform types 245 via the Internet. Similarly, the social networking system 210 and the gameplay system 205 can have one or more mobile servers for communicating with the various gameplay platform types 245 via a mobile network (e.g., GSM, PCS, Wi-Fi, WPAN, etc.). In some embodiments, one server may be able to communicate with the various gameplay platform types 245 over both the Internet and a mobile network. In other embodiments, separate servers may be used.

The various gameplay platform types 245 can receive and transmit game data 523 to and from the gameplay system 205. This data can include, for example, web pages, messages, game inputs, game displays, HTTP packets, data requests, transaction information, updates, and other suitable data. At some other time, or at the same time, the gameplay system 205 can communicate data 543, 547 (e.g., game state information, game system account information, page info, messages, HTTP packets, data requests, updates, etc.) with other networking systems, such as the social networking system 210 (e.g., Facebook®, Myspace®, etc.). The various gameplay platform types 245 can also receive and transmit data 527 to and from the social networking system 210. This data can include, for example, web pages, messages, social graph information, social network displays, HTTP packets, data requests, transaction information, updates, and other suitable data.

Communication between the various gameplay platform types 245, the social networking system 210, and the gameplay system 205 can occur over any appropriate electronic communication medium or network using any suitable communications protocols. For example, the various gameplay platform types 245, as well as various servers of the systems described herein, may include Transport Control Protocol/Internet Protocol (TCP/IP) networking stacks to provide for datagram and transport functions. Of course, any other suitable network and transport layer protocols can be utilized.

In addition, hosts or end-systems described herein may use a variety of higher layer communications protocols, including client-server (or request-response) protocols, such as the HyperText Transfer Protocol (HTTP) and other communications protocols, such as HTTP-S, FTP, SNMP, TELNET, and a number of other protocols, may be used. In addition, a server in one interaction context may be a client in another interaction context. In particular embodiments, the information transmitted between hosts may be formatted as HyperText Markup Language (HTML) documents. Other structured document languages or formats can be used, such as XML, and the like. Executable code objects, such as JavaScript and ActionScript, can also be embedded in the structured documents.

In some client-server protocols, such as the use of HTML over HTTP, a server generally transmits a response to a request from a client. The response may comprise one or more data objects. For example, the response may comprise a first data object, followed by subsequently transmitted data objects. In particular embodiments, a client request may cause a server to respond with a first data object, such as an HTML page, which itself refers to other data objects. A client application, such as a browser, will request these additional data objects as it parses or otherwise processes the first data object.

In particular embodiments, an instance of an online game can be stored as a set of game state parameters that characterize the state of various in-game objects, such as, for example, player character state parameters, non-player character parameters, and virtual item parameters. In particular embodiments, game state is maintained in a database as a serialized, unstructured string of text data as a so-called Binary Large Object (BLOB). When a player accesses an online game on the gameplay system 205, the BLOB containing the game state for the instance corresponding to the player can be transmitted to the various gameplay platform types 245 for use by a client-side executed object to process. In particular embodiments, the client-side executable may be a FLASH-based game, which can de-serialize the game state data in the BLOB. As a player plays the game, the game logic implemented at the various gameplay platform types 245 maintains and modifies the various game state parameters locally. The client-side game logic may also batch game events, such as mouse clicks, and transmit these events to the gameplay system 205. The gameplay system 205 may itself operate by retrieving a copy of the BLOB from a database or an intermediate memory cache (memcache) layer. The gameplay system 205 can also de-serialize the BLOB to resolve the game state parameters and execute its own game logic based on the events in the batch file of events transmitted by the client to synchronize the game state on the server side. The gameplay system 205 may then re-serialize the game state, now modified, into a BLOB and pass this to a memory cache layer for lazy updates to a persistent database.

With a client-server environment in which the online games may run, one server system, such as the gameplay system 205, may support the various gameplay platform types 245. At any given time, there may be multiple players at the various gameplay platform types 245 all playing the same online game. In practice, the number of players playing the same game at the same time may be very large. As the game progresses with each player, multiple players may provide different inputs to the online game at their respective gameplay platform types 245 and may transmit multiple player inputs and/or game events to the gameplay system 205 for further processing. In addition, the various gameplay platform types 245 may transmit other types of application data to the gameplay system 205.

In particular embodiments, a computer-implemented game may be a text-based or turn-based game implemented as a series of web pages that are generated after a player selects one or more actions to perform. The web pages may be displayed in a browser client executed on the various gameplay platform types 245. As an example and not by way of limitation, a client application downloaded to the various gameplay platform types 245 may operate to serve a set of web pages to a player. As another example and not by way of limitation, a computer-implemented game may be an animated or rendered game executable as a stand-alone application or within the context of a webpage or other structured document. In particular embodiments, the computer-implemented game may be implemented using Adobe Flash-based technologies. As an example and not by way of limitation, a game may be fully or partially implemented as a SWF object that is embedded in a web page and executable by a Flash media player plug-in. In particular embodiments, one or more described web pages may be associated with or accessed by the social networking system 210. This disclosure contemplates using any suitable application for the retrieval and rendering of structured documents hosted by any suitable network-addressable resource or website.

Application event data of a game is any data relevant to the game (e.g., player inputs). In particular embodiments, each application datum may have a name and a value, and the value of the application datum may change (i.e., be updated) at any time. When an update to an application datum occurs at the various gameplay platform types 245, either caused by an action of a game player or by the game logic itself, the various gameplay platform types 245 may need to inform the gameplay system 205 of the update. For example, if the game is a farming game with a harvest mechanic (such as Zynga FarmVille), an event can correspond to a player clicking on a parcel of land to harvest a crop. In such an instance, the application event data may identify an event or action (e.g., harvest) and an object in the game to which the event or action applies. For illustration purposes and not by way of limitation, the gaming environment 500 is discussed in reference to updating a multi-player online game hosted on a network-addressable system (such as, for example, the social networking system 210 or the gameplay system 205), where an instance of the online game is executed remotely on the various gameplay platform types 245, which then transmits application event data to the hosting system such that the remote game server synchronizes game state associated with the instance executed by the various gameplay platform types 245.

In particular embodiment, one or more objects of a game may be represented as an Adobe Flash object. Flash may manipulate vector and raster graphics, and supports bidirectional streaming of audio and video. "Flash" may mean the authoring environment, the player, or the application files. In particular embodiments, the various gameplay platform types 245 may include a Flash client. The Flash client may be configured to receive and run Flash application or game object code from any suitable networking system (such as, for example, the social networking system 210 or the gameplay system 205). In particular embodiments, the Flash client may be run in a browser client executed on the various gameplay platform types 245. A player can interact with Flash objects using the various gameplay platform types 245 and the Flash client. The Flash objects can represent a variety of in-game objects. Thus, the player may perform various in-game actions on various in-game objects by make various changes and updates to the associated Flash objects. In particular embodiments, in-game actions can be initiated by clicking or similarly interacting with a Flash object that represents a particular in-game object. For example, a player can interact with a Flash object to use, move, rotate, delete, attack, shoot, or harvest an in-game object. This disclosure contemplates performing any suitable in-game action by interacting with any suitable Flash object. In particular embodiments, when the player makes a change to a Flash object representing an in-game object, the client-executed game logic may update one or more game state parameters associated with the in-game object. To ensure synchronization between the Flash object shown to the player at the various gameplay platform types 245, the Flash client may send the events that caused the game state changes to the in-game object to the gameplay system 205. However, to expedite the processing and hence the speed of the overall gaming experience, the Flash client may collect a batch of some number of events or updates into a batch file. The number of events or updates may be determined by the Flash client dynamically or determined by the gameplay system 205 based on server loads or other factors. For example, the various gameplay platform types 245 may send a batch file to the gameplay system 205 whenever 50 updates have been collected or after a threshold period of time, such as every minute.

As used herein, the term "application event data" may refer to any data relevant to a computer-implemented game application that may affect one or more game state parameters, including, for example and without limitation, changes to player data or metadata, changes to player social connections or contacts, player inputs to the game, and events generated by the game logic. In particular embodiments, each application datum may have a name and a value. The value of an application datum may change at any time in response to the game play of a player or in response to the game engine (e.g., based on the game logic). In particular embodiments, an application data update occurs when the value of a specific application datum is changed. In particular embodiments, each application event datum may include an action or event name and a value (such as an object identifier). Thus, each application datum may be represented as a name-value pair in the batch file. The batch file may include a collection of name-value pairs representing the application data that have been updated at the various gameplay platform types 245. In particular embodiments, the batch file may be a text file and the name-value pairs may be in string format.

In particular embodiments, when a player plays an online game on the various gameplay platform types 245, the gameplay system 205 may serialize all the game-related data, including, for example and without limitation, game states, game events, user inputs, for this particular user and this particular game into a BLOB and stores the BLOB in a database. The BLOB may be associated with an identifier that indicates that the BLOB contains the serialized game-related data for a particular player and a particular online game. In particular embodiments, while a player is not playing the online game, the corresponding BLOB may be stored in the database. This enables a player to stop playing the game at any time without losing the current state of the game the player is in. When a player resumes playing the game next time, the gameplay system 205 may retrieve the corresponding BLOB from the database to determine the most-recent values of the game-related data. In particular embodiments, while a player is playing the online game, the gameplay system 205 may also load the corresponding BLOB into a memory cache so that the game system may have faster access to the BLOB and the game-related data contained therein.

In particular embodiments, one or more described web pages may be associated with a networking system or networking service. However, alternate embodiments may have application to the retrieval and rendering of structured documents hosted by any type of network addressable resource or web site. Additionally, as used herein, a user may be an individual, a group, or an entity (such as a business or third party application).

Figure 6:
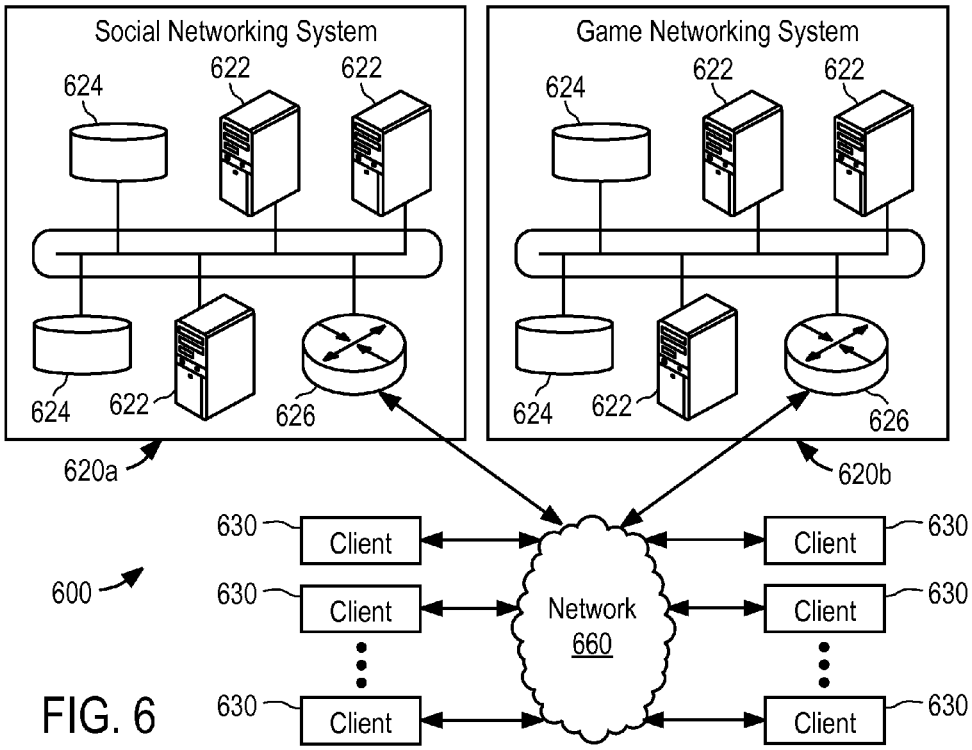
FIG. 6 is a block diagram illustrating an example network environment, according to an example embodiment.

FIG. 6 is a block diagram illustrating an example network environment 610, in which various example embodiments may operate. Particular embodiments may operate in a wide area network environment, such as the Internet, including multiple network addressable systems. Network cloud 660 generally represents one or more interconnected networks, over which the systems and hosts described herein, can communicate. Network cloud 660 may include packet-based wide area networks (such as the Internet), private networks, wireless networks, satellite networks, cellular networks, paging networks, and the like. As FIG. 6 illustrates, particular embodiments may operate in a network environment comprising one or more networking systems, such as social networking system 620*a*, game networking system 620*b*, and one or more client systems 630. The components of social networking system 620*a* and game networking system 620*b* operate analogously; as such, hereinafter they may be referred to simply at networking system 620. Client systems 630 are operably connected to the network environment via a network service provider, a wireless carrier, or any other suitable means.

Networking system 620 is a network addressable system that, in various example embodiments, comprises one or more physical servers 622 and data stores 624. The one or more physical servers 622 are operably connected to computer network 660 via, by way of example, a set of routers and/or networking switches 626. In an example embodiment, the functionality hosted by the one or more physical servers 622 may include web or HTTP servers, FTP servers, as well as, without limitation, web pages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), Flash, ActionScript, and the like.

Physical servers 622 may host functionality directed to the operations of networking system 620. Hereinafter servers 622 may be referred to as server 622, although server 622 may include numerous servers hosting, for example, networking system 620, as well as other content distribution servers, data stores, and databases. Data store 624 may store content and data relating to, and enabling, operation of networking system 620 as digital data objects. A data object, in particular embodiments, is an item of digital information typically stored or embodied in a data file, database, or record. Content objects may take many forms, including: text (e.g., ASCII, SGML, and HTML), images (e.g., jpeg, tif, and gif), graphics (vector-based or bitmap), audio, video (e.g., mpeg), or other multimedia, and combinations thereof. Content object data may also include executable code objects (e.g., games executable within a browser window or frame), podcasts, etc. Logically, data store 624 corresponds to one or more of a variety of separate and integrated databases, such as relational databases and object-oriented databases that maintain information as an integrated collection of logically related records or files stored on one or more physical systems. Structurally, data store 624 may generally include one or more of a large class of data storage and management systems. In particular embodiments, data store 624 may be implemented by any suitable physical system(s) including components, such as one or more database servers, mass storage media, media library systems, storage area networks, data storage clouds, and the like. In one example embodiment, data store 624 includes one or more servers, databases (e.g., MySQL), and/or data warehouses. Data store 624 may include data associated with different networking system 620 users and/or client systems 630.

Client system 630 is generally a computer or computing device including functionality for communicating (e.g., remotely) over a computer network. Client system 630 may be a desktop computer, laptop computer, personal digital assistant (PDA), in- or out-of-car navigation system, smart phone or other cellular or mobile phone, or mobile gaming device, among other suitable computing devices. Client system 630 may execute one or more client applications, such as a web browser (e.g., Microsoft Internet Explorer, Mozilla Firefox, Apple Safari, Google Chrome, and Opera), to access and view content over a computer network. In particular embodiments, the client applications allow a user of client system 630 to enter addresses of specific network resources to be retrieved, such as resources hosted by networking system 620. These addresses can be Uniform Resource Locators (URLs) and the like. In addition, once a page or other resource has been retrieved, the client applications may provide access to other pages or records when the user "clicks" on hyperlinks to other resources. By way of example, such hyperlinks may be located within the web pages and provide an automated way for the user to enter the URL of another page and to retrieve that page.

A webpage or resource embedded within a webpage, which may itself include multiple embedded resources, may include data records, such as plain textual information, or more complex digitally encoded multimedia content, such as software programs or other code objects, graphics, images, audio signals, videos, and so forth. One prevalent markup language for creating web pages is the Hypertext Markup Language (HTML). Other common web browser-supported languages and technologies include the Extensible Markup Language (XML), the Extensible Hypertext Markup Language (XHTML), JavaScript, Flash, ActionScript, Cascading Style Sheet (CSS), and, frequently, Java. By way of example, HTML enables a page developer to create a structured document by denoting structural semantics for text and links, as well as images, web applications, and other objects that can be embedded within the page. Generally, a webpage may be delivered to a client as a static document; however, through the use of web elements embedded in the page, an interactive experience may be achieved with the page or a sequence of pages. During a user session at the client, the web browser interprets and displays the pages and associated resources received or retrieved from the website hosting the page, as well as, potentially, resources from other websites.

When a user at a client system 630 desires to view a particular webpage (hereinafter also referred to as target structured document) hosted by networking system 620, the user's web browser, or other document rendering engine or suitable client application, formulates and transmits a request to networking system 620. The request generally includes a URL or other document identifier as well as metadata or other information. By way of example, the request may include information identifying the user, such as a user ID, as well as information identifying or characterizing the web browser or operating system running on the user's client computing device 630. The request may also include location information identifying a geographic location of the user's client system or a logical network location of the user's client system. The request may also include a timestamp identifying when the request was transmitted.

Although the example network environment 610 described above and illustrated in FIG. 6 described with respect to social networking system 620*a* and game networking system 620*b*, this disclosure encompasses any suitable network environment using any suitable systems. As an example and not by way of limitation, the network environment may include online media systems, online reviewing systems, online search engines, online advertising systems, or any combination of two or more such systems.

Figure 7:
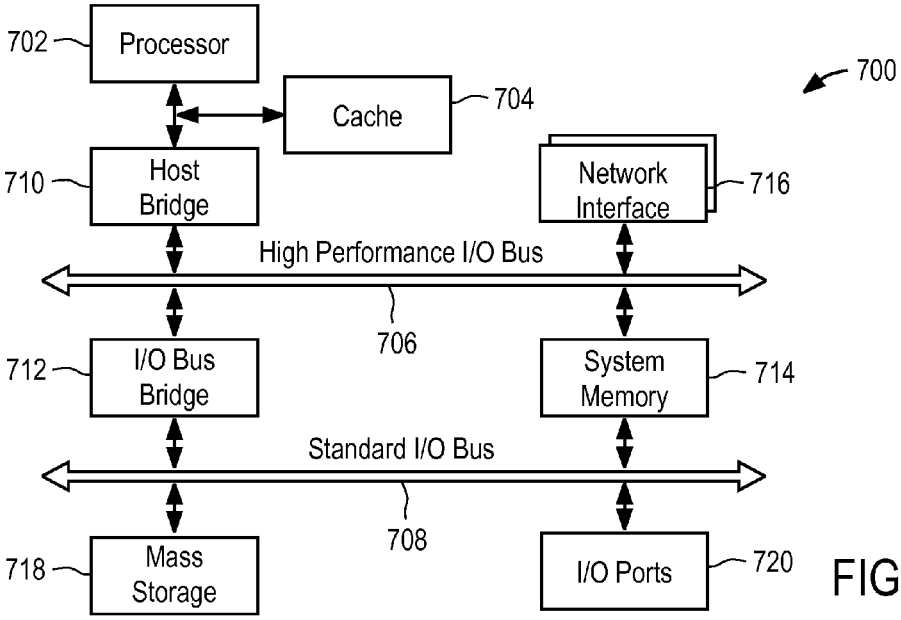
FIG. 7 is a block diagram illustrating an example computing system architecture, as may be used in an example embodiment.

FIG. 7 is a block diagram illustrating an example computing system architecture, which may be used to implement a server 622 or a client system 630. In one embodiment, hardware system 710 comprises a processor 702, a cache memory 704, and one or more executable modules and drivers, stored on a tangible computer readable medium, directed to the functions described herein. Additionally, hardware system 710 may include a high performance input/output (I/O) bus 706 and a standard I/O bus 708. A host bridge 710 may couple processor 702 to high performance I/O bus 706, whereas I/O bus bridge 712 couples the two buses 706 and 708 to each other. A system memory 714 and one or more network/communication interfaces 716 may couple to bus 706. Hardware system 710 may further include video memory (not shown) and a display device coupled to the video memory. Mass storage 718 and I/O ports 720 may couple to bus 708. Hardware system 710 may optionally include a keyboard, a pointing device, and a display device (not shown) coupled to bus 708. Collectively, these elements are intended to represent a broad category of computer hardware systems, including but not limited to general purpose computer systems based on the x86-compatible processors manufactured by Intel Corporation of Santa Clara, Calif., and the x86-compatible processors manufactured by Advanced Micro Devices (AMD), Inc., of Sunnyvale, Calif., as well as any other suitable processor.

The elements of hardware system 710 are described in greater detail below. In particular, network interface 716 provides communication between hardware system 710 and any of a wide range of networks, such as an Ethernet (e.g., IEEE 802.3) network, a backplane, etc. Mass storage 718 provides permanent storage for the data and programming instructions to perform the above-described functions implemented in the social networking server 230 and the game server 220, whereas system memory 714 (e.g., DRAM) provides temporary storage for the data and programming instructions when executed by processor 702. I/O ports 720 are one or more serial and/or parallel communication ports that provide communication between additional peripheral devices, which may be coupled to hardware system 710.

Hardware system 710 may include a variety of system architectures and various components of hardware system 710 may be rearranged. For example, cache 704 may be on-chip with processor 702. Alternatively, cache 704 and processor 702 may be packed together as a "processor module," with processor 702 being referred to as the "processor core." Furthermore, certain embodiments of the present disclosure may not require nor include all of the above components. For example, the peripheral devices shown coupled to standard I/O bus 708 may couple to high performance I/O bus 706. In addition, in some embodiments, only a single bus may exist, with the components of hardware system 710 being coupled to the single bus. Furthermore, hardware system 710 may include additional components, such as additional processors, storage devices, or memories.

An operating system manages and controls the operation of hardware system 710, including the input and output of data to and from software applications (not shown). The operating system provides an interface between the software applications being executed on the system and the hardware components of the system. Any suitable operating system may be used, such as the LINUX Operating System, the Apple Macintosh Operating System, available from Apple Computer Inc. of Cupertino, Calif., UNIX operating systems, Microsoft Windows® operating systems, BSD operating systems, and the like. Of course, other embodiments are possible. For example, the functions described herein may be implemented in firmware or on an application-specific integrated circuit.

Furthermore, the above-described elements and operations can be comprised of instructions that are stored on non-transitory storage media. The instructions can be retrieved and executed by a processing system. Some examples of instructions are software, program code, and firmware. Some examples of non-transitory storage media are memory devices, tape, disks, integrated circuits, and servers. The instructions are operational when executed by the processing system to direct the processing system to operate in accord with the disclosure. The term "processing system" refers to a single processing device or a group of inter-operational processing devices. Some examples of processing devices are integrated circuits and logic circuitry. Those skilled in the art are familiar with instructions, computers, and storage media.

Methods

Figure 8:
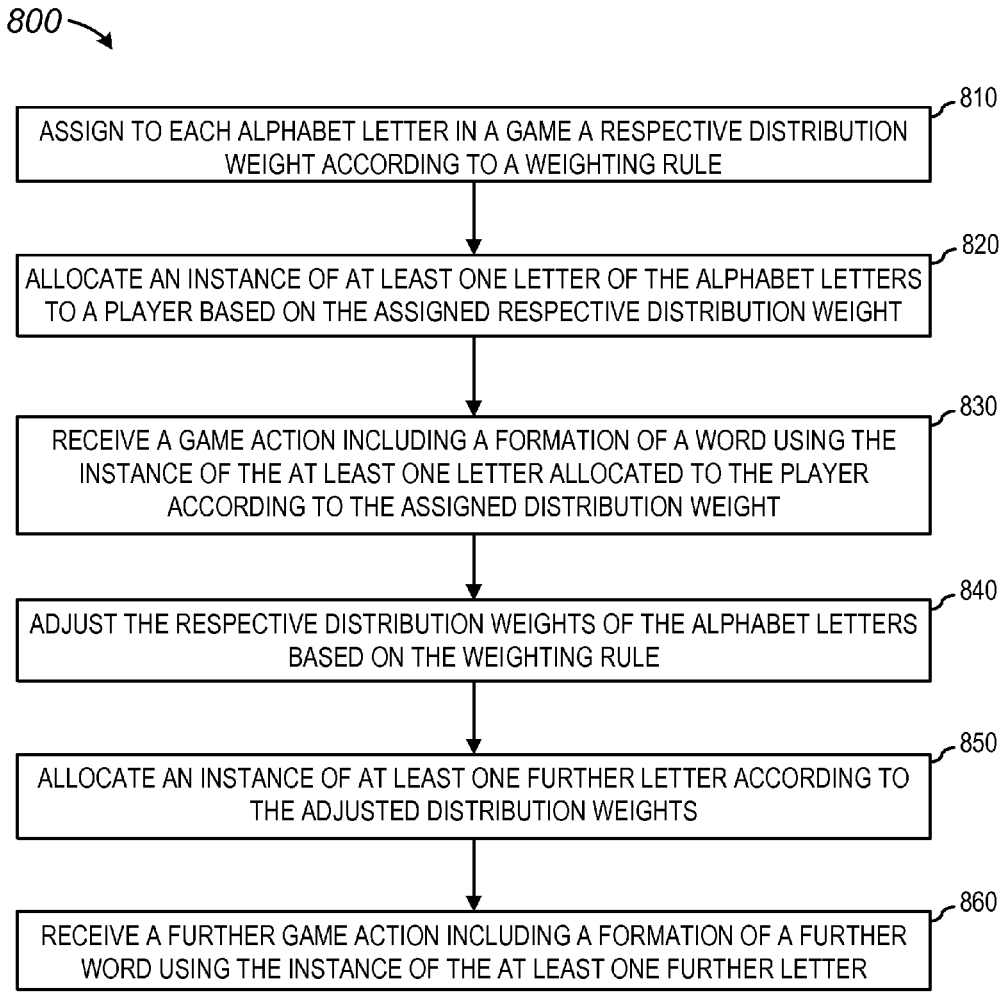
FIG. 8 is a flow chart illustrating a method to assign distribution weights to alphabet letters allocated in a game, according to an example embodiment.

FIG. 8 is a flow chart illustrating an allocation and distribution method 800, in accordance with an example embodiment, to assign and allocate distribution weights to alphabet letters in a game. The allocation and distribution method 800 may be performed by any of the modules, logic, or components described herein.

The various modules 404-416 of the game asset distribution module 400 may be involved in implementing the allocation and distribution method 800. In some embodiments, the rules module 416 may generally manage, and the weighting module 406 may impose, rules for pulling tiles out of the bag. The rules may produce a sort of "shaped" randomness in that the respective distribution weights of various letters within the alphabet letters may be adjusted to promote or hinder allocation of a respective letter in some situation or context of gameplay. The respective distribution weights of the alphabet letters according to some embodiments may determine a probability that the corresponding letter will be drawn by a player in a given gameplay action.

The allocation and distribution method 800 may commence with the weighting module 406 assigning 810 to each alphabet letter in a game a respective distribution weight according to a weighting rule communicated from the rules module 416. The method may continue with the game asset allocation module 415 allocating 820 an instance of at least one letter of the alphabet letters to a player based on the assigned distribution weight. The method may involve the gameplay system 205 receiving 830 a game action including a formation of a word using the instance of the at least one letter allocated to the player according to the assigned distribution weight. The method may next have the weighting module 406 adjusting 840 the respective distribution weights of the alphabet letters based on the weighting rule. The game asset allocation module 415 may be involved in allocating 850 an instance of at least one further letter according to the adjusted distribution weights. The gameplay system 205 may receive 860 a further game action including a formation of a further word using the instance of the at least one further letter. The instance of the at least one further letter may be allocated to the player or a further player.

Figure 9:
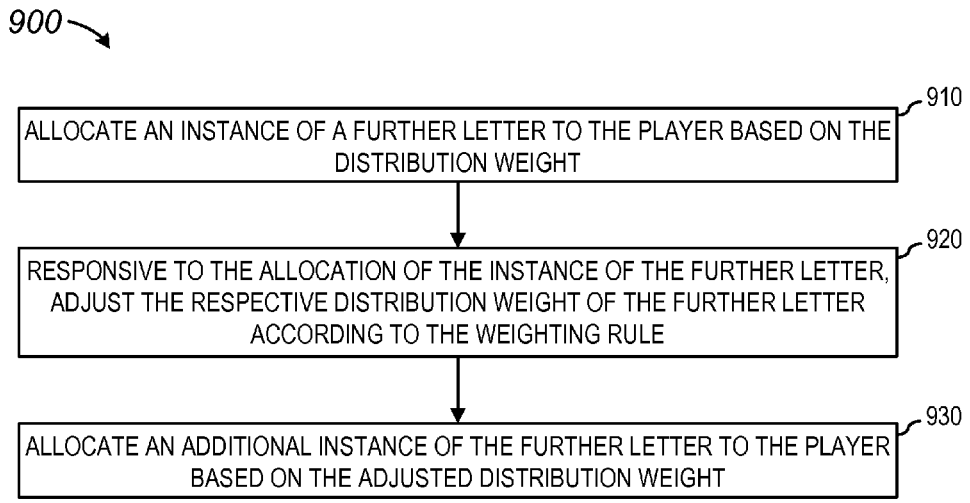
FIG. 9 is a flow chart illustrating a method to reduce successive allocations of the same letter, as may be used in some embodiments.

FIG. 9 is a flow chart illustrating a successive letter allocation method 900, in accordance with an example embodiment, to reduce successive allocations of the same letter. The successive letter allocation method 900 may be performed by any of the modules, logic, or components described herein.

As part of the promotion of the "shaped" randomness implemented by the rules, the weighting module 406 may increase or decrease the chances of getting a duplicate letter as a player receives the initial letter from a letter bag. In some embodiments, for example, if a player has already drawn an "N," for example, the weighting module 406, as directed by the rules module 416, may decrease the chances of drawing another "N" and greatly reduce the chances of drawing a third "N." The weighting module 406 may decrease a chance of getting duplicate letters by decreasing by 20% the chance of receiving a second letter of the same type, decreasing by 50% weight to get a third letter of the same type, and by 80% weight to get a fourth letter of the same type. Or, in other instances, the weighting module 406 may start decreasing weight only after the first duplicate tile is drawn (and perhaps more sharply decline the percentage thereafter).

In implementing the successive letter allocation method 900 the game asset allocation module 414 may allocate 910 a first instance of a letter to the player based on an initial distribution weight. In response to the allocation of the first instance of the letter, the weighting module 406 may adjust 920 the distribution weight of the letter according to the weighting rule used in moderating a player's drawing successive letters. In further game action the game asset allocation module 414 may be involved in the method by allocating 930 an additional instance of the letter to the player based on the adjusted distribution weight. The allocation of the additional instance of the letter may occur even though the adjusted distribution weight is less than a prior distribution weight assigned to the letter. Because of the adjusted distribution weight according to these rules, the chances of this happening for the player are diminished.

Figure 10:
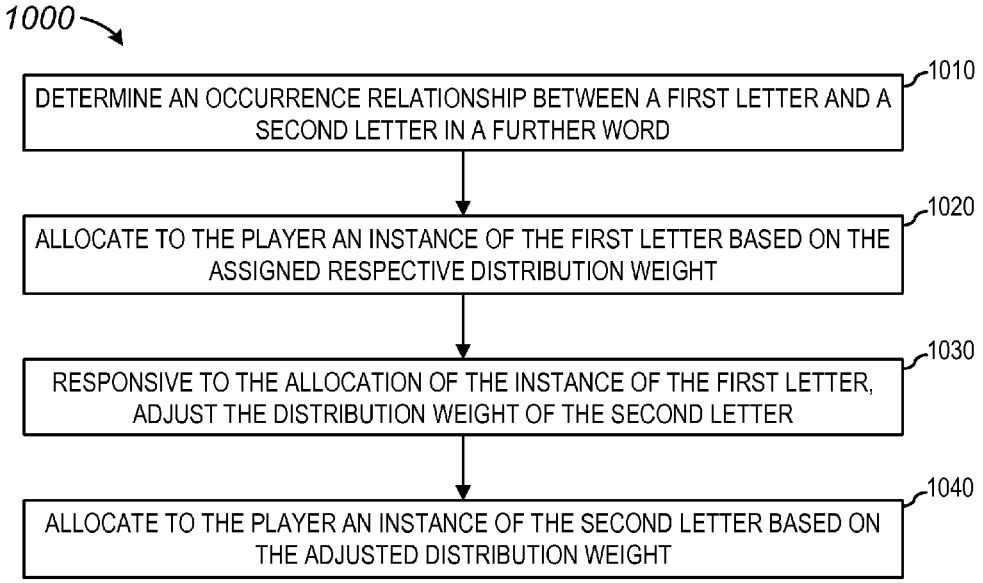
FIG. 10 is a flow chart illustrating a method to allocate letters occurring in relationship within a word, as may be used in an example embodiment.

FIG. 10 is a flow chart illustrating a related letter allocation method 1000, in accordance with an example embodiment, to allocate letters occurring in relationship within a word. The related letter allocation method 1000 may be performed by any of the modules, logic, or components described herein.

The weighting module 406 may increase the chances of drawing letters in proportion to common relationships among letter combinations occurring in the formation of certain words. For example, if a player draws a "Q," the weighting module 406 may greatly increase chances of drawing a "U." If the player draws a "C," the weighting module 406 may promote drawing a "K." If the player draws a "K," the weighting module 406 may increase the weight of getting a "C" by 50%. If the player draws a "Y," the weighting module 406 may increase the weight of "L" by 30%. Or, if the player draws an "H," the weighting module 406 may increase the weight of the letters "S," "C," "T," "P," "G," and "W" by 30%. The weighting module 406 may change the percentage chance of drawing a letter anywhere from +0 to +100%.

In some embodiments, in addition to promoting letter draws that have synergy with previously drawn letters, the weighting module 406 may also lessen or eliminate the chance for the player to get two or more of any combination of the letters "Z," "X," "J," or "Q." Another rule managed by the rules module 416 may be to not allocate more than two of the following letters: "A," "U," "O," "I," "W," and "H" and not to give more than one of the following letters: "K," "Q," "X," and "J." If a player draws a "J," the weighting module 406 may increase the weight of "A" and "U" by 30% and decrease the weight of "I" by 30%. Finally, the weighting module 406 may adjust these draws based on new analysis received from the analysis module 408 for words played across the player community.

The related letter allocation method 1000 method may determine 1010 an occurrence relationship between a first letter and a second letter in a word. The game asset allocation module 414 may be involved in the method to allocate 1020 to the player an instance of the first letter based on the assigned distribution weight. In response to the allocation of the instance of the first letter, the method may adjust 1030 the distribution weight of the second letter by incorporating the weighting module 406. In later game action the gameplay system 205 allocate 1040 to the player an instance of the second letter based on the adjusted distribution weight. The adjusted distribution weight assigned to the second letter may be greater than a prior distribution weight when the relationship between the two letters is synergistic and it may be desirable for the second letter to occur in word formation with the first letter. The complement may be true when the first letter is difficult to play in game action and having a second letter of similar playing difficulty would produce a significant obstacle to reasonable gameplay action.

Figure 11:
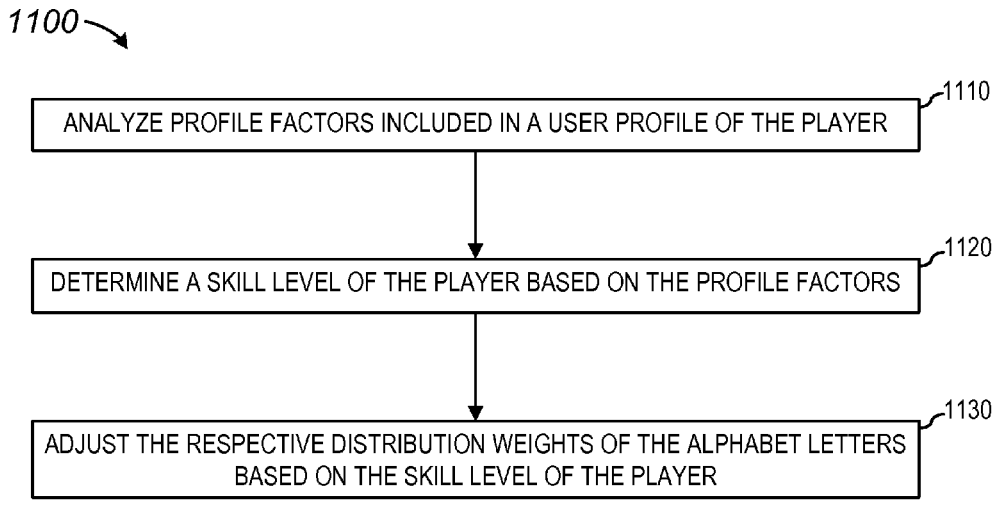
FIG. 11 is a flow chart illustrating a method to adjust distribution weights of alphabet letters according to player skill level, according to some embodiments.

FIG. 11 is a flow chart illustrating a distribution by skill level method 1100, in accordance with an example embodiment, to adjust distribution weights of alphabet letters according to player skill level. The distribution by skill level method 1100 may be performed by any of the modules, logic, or components described herein.

In some embodiments, the user profile module 412 may be used to implement a gameplay mechanism allowing a way for players having moderate skill levels to play competitively with highly skilled players. The moderately skilled player might typically take a handicap in match play with highly skilled players. Yet, for the moderately skilled player who still wants to compete with highly skilled players, the gameplay mechanism may still allow the players of disparate skill levels to compete in the same game and have a meaningful gaming experience. In some embodiments, the objective may be to make games more "even" than would be the case without the distribution by skill level method 1100. Toward this end, the game promotion module 410 and the game asset distribution module 400 may work together to increase the chance of a lesser-skilled player drawing a certain letter to catch up with other, higher-skilled players.

In some embodiments, the user profile module 412 and the rules module 416 may combine to skew the letters such that it is really difficult for an expert player to score points against a neophyte. This is a mechanism that may be used in cases where someone of an advanced skill level desires to play someone of a much more modest skill level. For instance, a parent wanting to play against a young child would be in this situation. In these embodiments, the lesser-skilled player may selectively toggle the game asset weighting feature or, more generally, a game play balancing feature, to ensure a leveling of the competition.

Towards these ends, the distribution by skill level method 1100 may incorporate the user profile module 412 and the analysis module 408 in analyzing 1110 profile factors included in a user profile of the player. The analysis module 408 may then determine 1120 a skill level of the player based on the profile factors. The method may continue by adjusting 1130, with the weighting module 406, the respective distribution weights of the alphabet letters based on the skill level of the player. One profile factor used by the user profile module 412 and the analysis module 408 may be a game history of the player.

When the skill level of the player is determined to be higher than a predetermined threshold, adjusting the respective distribution weights of the alphabet letters may include increasing a distribution weight of high-point alphabet letters and decreasing a distribution weight of low-point alphabet letters. According to these adjusted distribution weights the highly skilled player will receive more draws of high-point alphabet letters which are relatively more difficult to use in word formations than low-point alphabet letters. Likewise, the highly skilled player will tend to receive fewer of the low-point alphabet letters which are relatively easier to play in the formation of words. In this way, the highly skilled player will be challenged to accomplish the formation of words in game action. The more highly skilled a player may be the more accentuated the adjustments to the respective distribution weights of high-point alphabet letters and low-point alphabet letters may be to contribute to normalizing gameplay with the less-skilled player.

The advantages of this feature include the balancing of game play in games, particularly word games, where a memorizable knowledge set of a dictionary puts some players at a significant advantage over other players, and particularly new players. The advantages of this draw-shaping system (i.e., distribution weight adjustment system) lie in its adaptability: analysis and player requests coupled with this system can help to create more engaging play sessions with higher player retention and a reduced frequency of player frustration. Players who feel "beat down" in a game tend to not want to play again, and this system helps to mitigate some of this feeling.

Figure 12:
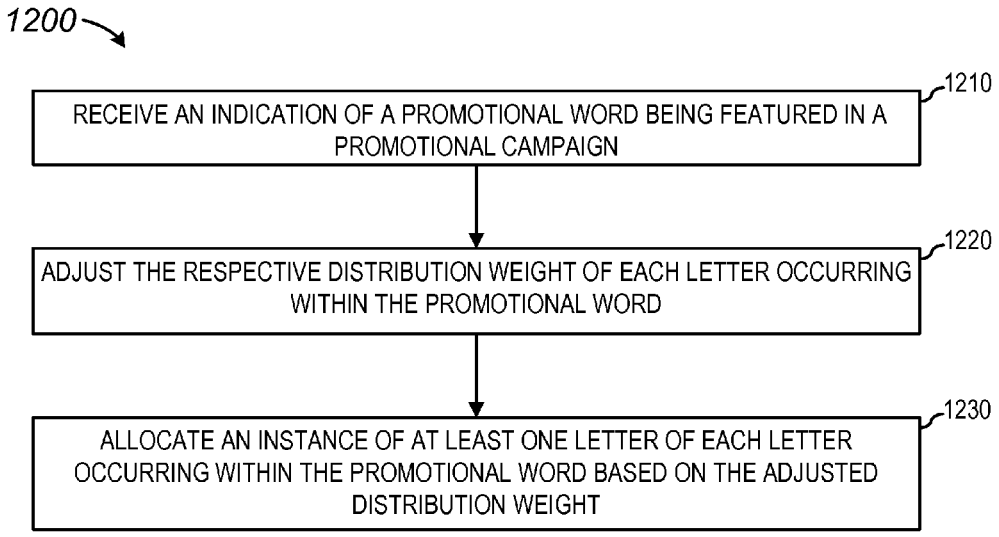
FIG. 12 is a flow chart illustrating a method to adjust distribution weights of letters occurring in a promotional word, as may be used in some embodiments.

FIG. 12 is a flow chart illustrating a promotional campaign method 1200, in accordance with an example embodiment, to adjust distribution weights of letters occurring in a promotional word. The promotional campaign method 1200 may be performed by any of the modules, logic, or components described herein.

In some embodiments, one or there may be a special type of gameplay, the game promotion module 410 may stack the letter tray such that a player may play a keyword related to a theme. For example, if there is a contest with a soda manufacturer, the game promotion module 410 may weight certain letters occurring in promotional words more heavily so as to provide more letters to the player to spell the name of that soda manufacturer or the name of a particular drink product.

The "draw-shaping" by adjusting distribution weights of certain letters can help to facilitate new and engaging avenues of advertising, such as promoting an opportunity to spell key words being promoted by the advertiser. The shaping of letter draws with distribution weight adjustments is subtle and would not necessarily be observable by any player in the game. The effect though may be more frequent formation of the promotional words. As a result, more overall participation in an ad campaign by players may be accomplished.

The method may start out with the gameplay system 205 receiving 1210 and an indication of a promotional word being featured in a promotional campaign. The gameplay system 205 may continue implementing the method by adjusting 1220 the respective distribution weight of each letter occurring within the promotional word with the weighting module 406. The method may continue by allocating 1230 to a player an instance of any of the letters occurring within the promotional word based on the adjusted distribution weights of the letters occurring in a promotional word(s). The adjusted distribution weights of the letters occurring within the promotional word(s), is greater than a prior distribution weight. In this way the game asset distribution module 400 may provide a higher likelihood that promotional words will be played in a word game during an advertising campaign and that players are highly motivated to participate in the campaign.

Figure 13:
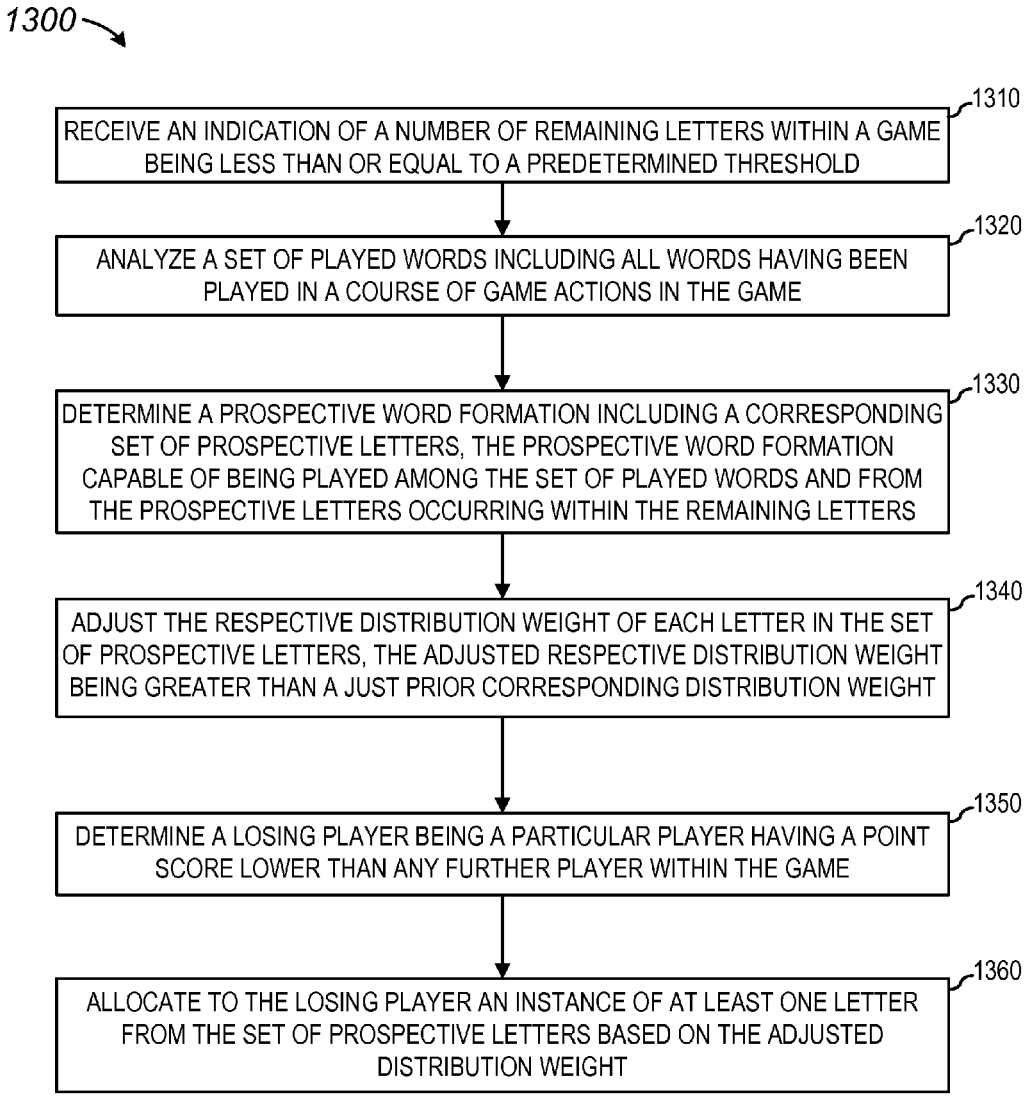
FIG. 13 is a flow chart illustrating a method to adjust distribution weights of letters to be allocated to a losing player, as may be used in an example embodiment.

FIG. 13 is a flow chart illustrating a losing player allotment method 1300, in accordance with an example embodiment, to adjust distribution weights of letters to be allocated to a losing player. The losing player allotment method 1300 may be performed by any of the modules, logic, or components described herein.

In some embodiments, it may be an objective of the game to enhance the experience of a losing player especially during the endgame or closing plays of the game. In some embodiments, any one of the analysis module 408, the rules module 416, and the game promotion module 410 may be used to increase a losing player's chance of drawing powerful game tiles, such as a "Q," "J," "X," which are worth many points in some word games. This type of enhancement of a game may help to provide higher scoring opportunities for the losing player but may not be useful unless the losing player is of a skill level capable of readily turning the high-point letters into word formations.

In some embodiments, the game promotion module 410 may allocate or weight certain letters by comparing a word list (having a significantly large number of possible words) to the layout of the board to assess what possible word formations are prospectively available in further game play. Tiles that a player needs to build a high-scoring word or which are needed to play words that allow the player's tile rack to be emptied prior to the end of the game may be preferentially allocated. The player still has to know how to build the words and have the appropriate skill level for doing so.

For example, in some word games, it could be guaranteed that a player can put a word on the board every time. Such guarantees may satisfy a need since in some games, if the player has remaining tiles at the end of a game, the sum of the letters' point values are counted against the player. This negative and possibly dejecting result at the end of the game may be a point of confusion or disappointment on the part of a losing player. A game objective may be to not allow the drawing of certain tiles by a player if the letters on those tiles are already on the player's letter rack. It may also be an objective of the game to add tiles that would improve a user's chances of forming a word that is assured of appearing in a dictionary. In each case, one of the benefits provided by the system is that users assume letter draws are random, yet the gameplay system 205 may subtly shape the distribution weights of letters to promote engaging gameplay.

The losing player allotment method 1300 may commence with the gameplay system 205 receiving 1310 an indication of a number of remaining letters within a game being less than or equal to a predetermined threshold. The determination of this number of remaining letters indicates the game is entering a state of play commonly known as the endgame. The predetermined threshold may be implemented according to the rules module 416 and the indication may be made in conjunction with the analysis module 408 in some embodiments. In this way the game asset distribution module 400 may effectively track the state of gameplay and determine that the endgame has commenced. The method may continue by utilizing the analysis module 408 in analyzing 1320 a set of played words including all words having been played in a course of game actions within the game.

The method may again incorporate the rules module 416 in determining 1330 a prospective word formation including a corresponding set of prospective letters. The prospective word formation is capable of being played by the losing player among the set of played words with the prospective letters that occur within the remaining letters. The method may incorporate the weighting module 406 in adjusting 1340 the respective distribution weight of each letter in the set of prospective letters. The adjusted distribution weights are greater than the prior corresponding distribution weights of the respective letters.

The method continues by determining 1350 a losing player as that particular player that has a point score lower than any further player within the game. The method may incorporate the game asset allocation module 414 in allocating 1360 to the losing player an instance of at least one letter from the set of prospective letters based on the adjusted distribution weight.

Figure 14:
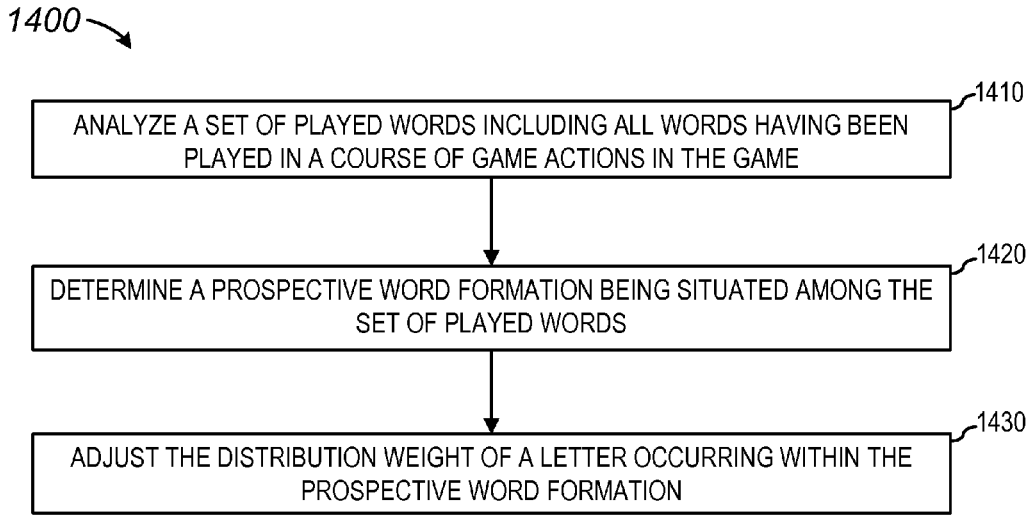
FIG. 14 is a flow chart illustrating a method to adjust distribution weights of letters within prospective word formations, according to some embodiments.

FIG. 14 is a flow chart illustrating a prospective distribution method 1400, in accordance with an example embodiment, to adjust distribution weights of letters within prospective word formations. The prospective distribution method 1400 may be performed by any of the modules, logic, or components described herein.

In some embodiments, the analysis module 408, in conjunction with the weighting module 406, may allocate or weight certain letters by comparing a list of possible words to the layout of the board, including all of the played words, and only allocate letters that a player needs to build certain of the possible words capable of being played in the present game. The player would still have to know how to build the available words. For example, the analysis module 408 may be utilized in analyzing 1410 a set of played words including all words having been played in a course of game actions in the game. The analysis module 408 may also be utilized in determining 1420 a prospective word formation being situated among the set of played words. Next, the weighting module 406 may be involved in adjusting 1430 the distribution weight of a letter occurring within the prospective word formation. The adjusted distribution weight of the letter may be adjusted by the weighting module 406 to be greater than a prior distribution weight assigned to the letter. In this way, the distribution weight of letters occurring in prospective words, that are capable of being played in the game, are adjusted so that the player has a higher probability of receiving these letters in a further game action and therefore have the highest potential for forming one of the prospective words.

Figure 15:
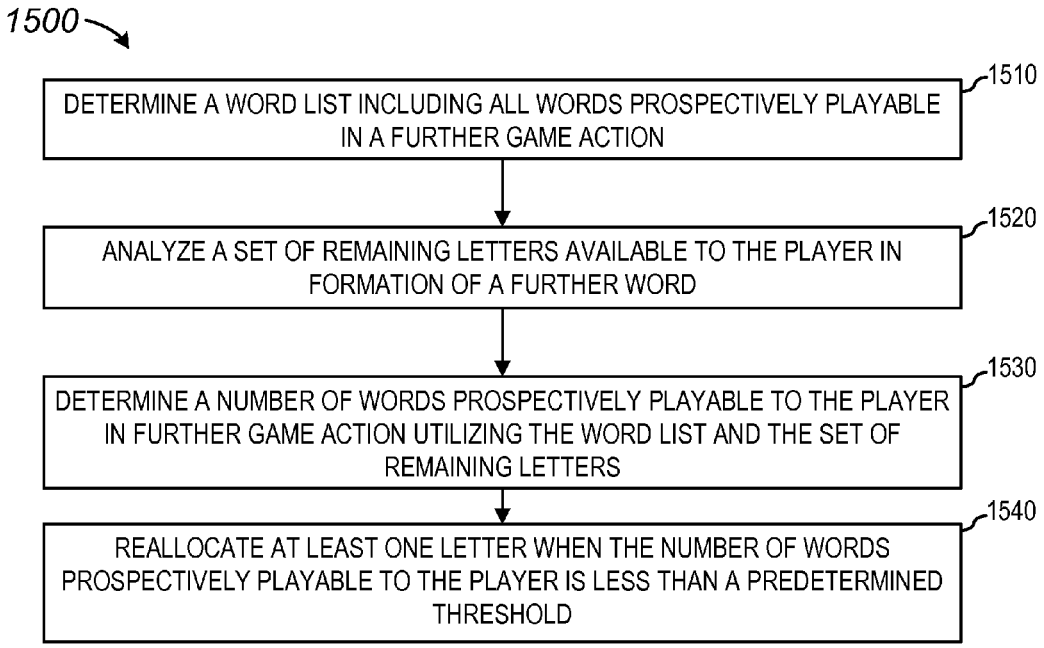
FIG. 15 is a flow chart illustrating a method to maintain a minimum number of prospective word formations, as may be used in some embodiments.

FIG. 15 is a flow chart illustrating a minimum word method 1500, in accordance with an example embodiment, to maintain a minimum number of prospective word formations. The minimum word method 1500 may be performed by any of the modules, logic, or components described herein.

In some word games, the game promotion module 410 and the game asset allocation module 414 may ensure the possibility of forming at least one word or possibly forming at least an 8-letter word (though the player would still have to perceive the possibility of playing the word and take action to play the word in each case). These word formation possibilities are ensured by discarding certain of the player's present letters and reallocating further letters until the player's tile rack includes a mix of tiles that can be arranged into an 8-letter word (or at least one word).

A further possible general objective of the game may be to guarantee a minimum number of potential words being playable by the player on any given turn. The weighting module 406, the game promotion module 410, and the game asset allocation module 414 may be responsible to enforce the condition, for example, that there has to be at least ten words the player may prospectively make. If the letters in player's tile rack do not meet the condition, certain letters may be discarded and further replacement letters allocated. In some embodiments, weighting conditions may be based on popularity of certain words in general gameplay, as determined by analysis obtained by the analysis module 408, so people that are novices may still get tiles that provide a minimum of 5 common words.

In some embodiments, either the rules module 416 or the game promotion module 410 may weight and allocate certain letters toward the objective of a player having a minimum word-play possibility by comparing a word list to the layout of the board and only allocating the tiles that a player needs to make a playable word formation. The player would still have to know how to build the word. The assurance that the player may be able to at least make a minimum number of word formations in each turn helps to minimize the number of remaining tiles that are not used at the end of a game. This helps to minimize the point total of the remaining tiles that may be accumulated and counted against the player (discussed above).

The minimum word method 1500 may commence with the analysis module 408 determining 1510 a word list including all words prospectively playable in a further game action and analyzing 1520 a set of remaining letters available to the player in formation of a further word. The analysis module 408 may be further utilized in determining 1530 a number of words prospectively playable by the player in further game action utilizing the word list and the set of remaining letters. The method may culminate with the game asset allocation module 414 reallocating 1540 at least one letter when the number of words prospectively playable by the player is less than a predetermined threshold. In this way, the game asset distribution module 400 may ensure that an optimal number of word formations are playable by the player by assessing possible playable words, determining the number of those words that are prospectively playable by the player, and managing the reallocation of letters to fulfill the optimization of possible word formations.

Figure 16:
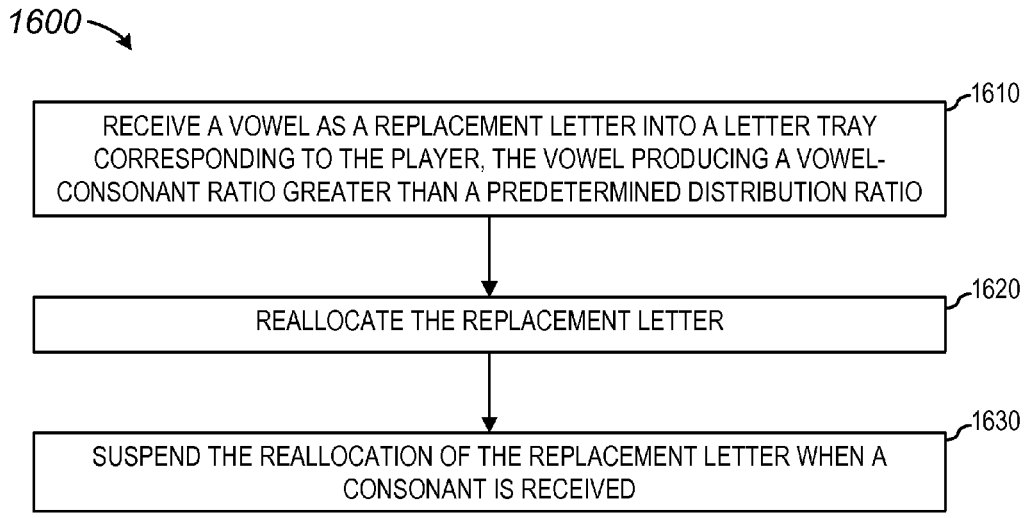
FIG. 16 is a flow chart illustrating a method to maintain a predetermined distribution ratio of vowels-to-consonants, as may be used in an example embodiment.

FIG. 16 is a flow chart illustrating a distribution ratio maintenance method 1600, in accordance with an example embodiment, to maintain a predetermined distribution ratio of vowels-to-consonants. The distribution ratio maintenance method 1600 may be performed by any of the modules, logic, or components described herein.

An objective of the gameplay system 205 to increase or decrease the length of words that are formed by players. Toward this objective, the game asset distribution module 400 may increase or decrease letter percentages by adjusting the corresponding distribution weights of the letters (and therefore adjust the probability of a player drawing the corresponding letters) in the desired percentages. An additional, yet related objective of the game may be to ensure that a certain ratio of vowels-to-consonants is maintained in order to optimize the scope of available word formations to the players. By maintaining the predetermined ratio of vowels-to-consonants, ensuring that the set of prospective word formations available to the player is broad enough to satisfy the overarching objective of word length in gameplay is significantly easier.

In order to meet these objectives the ratio maintenance method 1600 may commence with the gameplay system 205 receiving 1610 a vowel as a replacement letter into a letter tray corresponding to the player. Receipt of the vowel may produce a vowel-consonant ratio greater than a predetermined distribution ratio. The game asset distribution module 400 may reallocate 1620 the replacement letter with another letter utilizing the game asset allocation module 414. The method may proceed by suspending 1630 the reallocation of the replacement letter when a consonant is received. Receipt of the consonant at this point in the game assures that the vowel-consonant ratio is reestablished.

In embodiments of some word games, two letter bags, one populated only with vowels and the other with only consonants, may be used. Separating vowels and consonants into separate bags permits the game asset distribution module 402 to specify, when tiles are drawn, that a mix of letters facilitating and easing word formation is maintained. In some embodiments, four vowels and eight consonants are drawn, though this number may be made to be extremely variable. In some embodiments, the random generator module 404 may select or draw a random number of tiles from each bag. For example, the random generator module 404 may select or provide six to nine consonants, with the remaining slots to fill the player's tile rack being filled with vowels. An objective may be to ensure the player always has a tile-mix that allows them to easily build words. This concept can also be used to help balance gameplay among players with differing skill levels, which may help a disadvantaged layer remain competitive with opponents of a higher skill level.

In further word game embodiments played with languages other than English, the rules above may change. Changes required in the rules may be determined through measuring the words played in analysis provided by the analysis module 408 and provided to the rules module 416 for implementation with a different language. For example, rules utilized in the implementation of the method to reduce successive allocations of the same letter may simply have letters occurring in the alternate language implemented in the rule maintained by the rules module 416. According to further embodiments, the rules incorporated in producing the method to allocate letters occurring in relationship within a word may again simply have related letter sets occurring in the alternate language provided to the rules module 416. Generally the tasks of adjusting distribution weights and allocating letters provided by the weighting module 406 and the game asset allocation module 414 are fundamentally the same for the methods presented here to be implemented in the alternate language as they were for the English language. An adaptation for the appropriate words and corresponding letters of the alternate language need only be provided to modules such as the analysis module 400 a and a rules module 416, for example, in order to provide the same results in the alternate language that these methods provided with the English language.

The adaptations to accommodate an alternate language may also include non-letter asset tiles for example, according to some embodiments; an alternate language may incorporate characters such as a hyphen in word formation. These game assets may be included within the methods described above and as prescribed by the alternate language in order to accomplish acceptable word formation within the alternate language and be able to use the methods described above.

Modules, Components and Logic

Certain embodiments are described herein as including logic or a number of components, modules, or mechanisms.

Modules may constitute either software modules (e.g., code embodied (1) on a non-transitory machine-readable medium or (2) in a transmission signal) or hardware-implemented modules. A hardware-implemented module is tangible unit capable of performing certain operations and may be configured or arranged in a certain manner. In example embodiments, one or more computer systems (e.g., a standalone, client or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired) or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules can provide information to, and receive information from, other hardware-implemented modules. Accordingly, the described hardware-implemented modules may be regarded as being communicatively coupled. Where multiple of such hardware-implemented modules exist contemporaneously, communications may be achieved through signal transmission (e.g., over appropriate circuits and buses) that connect the hardware-implemented modules. In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation, and store the output of that operation in a memory device to which it is communicatively coupled. A further hardware-implemented module may then, at a later time, access the memory device to retrieve and process the stored output. Hardware-implemented modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), these operations being accessible via a network (e.g., the Internet) and via one or more appropriate interfaces (e.g., Application Program Interfaces (APIs).)

Electronic Apparatus and System

Example embodiments may be implemented in digital electronic circuitry, or in computer hardware, firmware, software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program can be written in any form of programming language, including compiled or interpreted languages, and it can be deployed in any form, including as a stand-alone program or as a module, subroutine, or other unit suitable for use in a computing environment. A computer program can be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations can also be performed by, and apparatus of example embodiments may be implemented as, special purpose logic circuitry, e.g., a field programmable gate array (FPGA) or an application-specific integrated circuit (ASIC).

The computing system can include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that that both hardware and software architectures require consideration. Specifically, it will be appreciated that the choice of whether to implement certain functionality in permanently configured hardware (e.g., an ASIC), in temporarily configured hardware (e.g., a combination of software and a programmable processor), or a combination of permanently and temporarily configured hardware may be a design choice. Below are set out hardware (e.g., machine) and software architectures that may be deployed, in various example embodiments.

Machine Architecture

Figure 17:
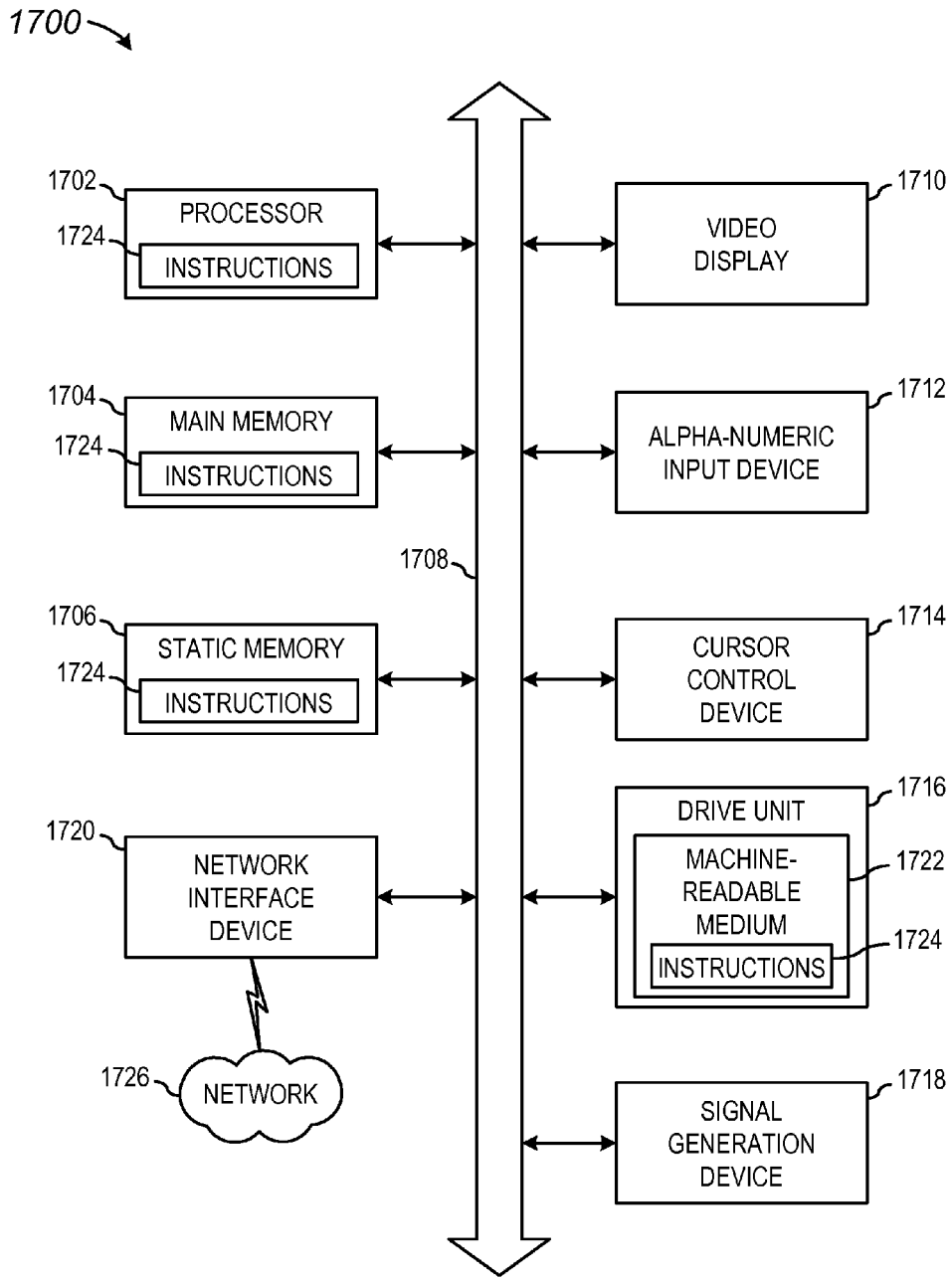
FIG. 17 is a block diagram of machine in the example form of a computer system within which a set instructions, for causing the machine to perform any one or more of the methodologies discussed herein may be executed.

FIG. 17 is a block diagram of machine in the example form of a computer system 1700 within which instructions, for causing the machine to perform any one or more of the methodologies discussed herein, may be executed. In alternative embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1700 includes a processor 1702 (e.g., a central processing unit (CPU), a graphics processing unit (GPU) or both), a main memory 1704 and a static memory 1706, which communicate with each other via a bus 1708. The computer system 1700 may further include a video display unit 1710 (e.g., a liquid crystal display (LCD) or a cathode ray tube (CRT)). The computer system 1700 also includes an alphanumeric input device 1712 (e.g., a keyboard), a user interface (UI) navigation device 1714 (e.g., a mouse), a disk drive unit 1716, a signal generation device 1718 (e.g., a speaker) and a network interface device 1720.

Machine-Readable Medium

The disk drive unit 1716 includes a machine-readable medium 1722 on which is stored one or more sets of instructions and data structures (e.g., software) 1724 embodying or utilized by any one or more of the methodologies or functions described herein. The instructions 1724 may also reside, completely or at least partially, within the main memory 1704 and/or within the processor 1702 during execution thereof by the computer system 1700, the main memory 1704 and the processor 1702 also constituting machine-readable media.

While the machine-readable medium 1722 is shown in an example embodiment to be a single medium, the term "machine-readable medium" may include a single medium or multiple media (e.g., a centralized or distributed database, and/or associated caches and servers) that store the one or more instructions or data structures. The term "machine-readable medium" shall also be taken to include any tangible medium that is capable of storing, encoding or carrying instructions for execution by the machine and that cause the machine to perform any one or more of the methodologies of the present invention, or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including by way of example semiconductor memory devices, e.g., Erasable Programmable Read-Only Memory (EPROM), Electrically Erasable Programmable Read-Only Memory (EEPROM), and flash memory devices; magnetic disks such as internal hard disks and removable disks; magneto-optical disks; and CD-ROM and DVD-ROM disks.

Transmission Medium

The instructions 1724 may further be transmitted or received over a communications network 1726 using a transmission medium. The instructions 1724 may be transmitted using the network interface device 1720 and any one of a number of well-known transfer protocols (e.g., HTTP). Examples of communication networks include a local area network ("LAN"), a wide area network ("WAN"), the Internet, mobile telephone networks, Plain Old Telephone (POTS) networks, and wireless data networks (e.g., WiFi and WiMax networks). The term "transmission medium" shall be taken to include any intangible medium that is capable of encoding or carrying instructions for execution by the machine, and includes digital or analog communications signals or other intangible media to facilitate communication of such software.

Although an embodiment has been described with reference to specific example embodiments, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although the present invention has been described with reference to specific example embodiments, it will be evident that various modifications and changes may be made to these embodiments without departing from the broader scope of the invention. Accordingly, the specification and drawings are to be regarded in an illustrative rather than a restrictive sense.

Plural instances may be provided for components, operations, or structures described herein as a single instance. Finally, boundaries between various components, operations, and data stores may be somewhat arbitrary, and particular operations may be illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements fall within the scope of the invention(s).

One or more features from any embodiment may be combined with one or more features of any other embodiment without departing from the scope of the disclosure.

A recitation of "a", "an," or "the" is intended to mean "one or more" unless specifically indicated to the contrary. In addition, it is to be understood that functional operations, such as "awarding," "locating," "permitting," and the like, are executed by game application logic that accesses, and/or causes changes to, various data attribute values maintained in a database or other memory.

In this document, the terms "a" or "an" are used, as is common in patent documents, to include one or more than one. In this document, the term "or" is used to refer to a nonexclusive or, such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

The present disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend.

For example, the methods, game features, and game mechanics described herein may be implemented using hardware components, software components, and/or any combination thereof. By way of example, while embodiments of the present disclosure have been described as operating in connection with a networking website, various embodiments of the present disclosure can be used in connection with any communications facility that supports web applications. Furthermore, in some embodiments the term "web service" and "website" may be used interchangeably and additionally may refer to a custom or generalized API on a device, such as a mobile device (e.g., cellular phone, smart phone, personal GPS, personal digital assistance, personal gaming device, etc.), that makes API calls directly to a server. Still further, while the embodiments described above operate with business-related virtual objects (such as stores and restaurants), the invention can be applied to any in-game asset around which a harvest mechanic is implemented, such as a virtual stove, a plot of land, and the like. The specification and drawings are, accordingly, to be regarded in an illustrative rather than a restrictive sense. It will, however, be evident that various modifications and changes may be made thereunto without departing from the broader spirit and scope of the disclosure as set forth in the claims and that the disclosure is intended to cover all modifications and equivalents within the scope of the following claims.

The Abstract of the Disclosure is provided to comply with rules requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A computer-implemented method comprising:

assigning, via at least one processor, to each alphabet letter a respective distribution weight according to a weighting rule of an online game, wherein each respective distribution weight reflects a frequency the corresponding alphabet letter, to which the respective distribution weight is assigned, is available for a game action in the online game of a game network server system;

allocating based on respective assigned distribution weights, for availability in one or more game actions by a particular player, instances of each alphabet letter in a plurality of the alphabet letters;

initiating display, to the particular player, of the allocated instances of each alphabet letter in a game interface of the online game;

receiving a game action representing completion of a formation of a word, the word based on selection of a subset of the allocated instances of each alphabet letter;

determining a losing player being the particular player having a point score in the online game lower than any further player within the online game, wherein each further player has a respective social network connection in a social network server system with the particular player;

based on determining the losing player being the particular player:

determining a number of remaining instances of the alphabet letters, available for distribution, and yet to be allocated to the losing player, in accordance to the respective distribution weights and the plurality of alphabet letters previously allocated to the losing player;

determining the number of the remaining instances of the alphabet letters is less than or equal to a predetermined threshold;

comparing a set of played words based on one or more words previously formed in one or more game action selected by the losing player in the online game;

determining a prospective word formation, in a subset of the remaining instances of the alphabet letters, matches at least one of the words previously formed;

adjusting the respective distribution weight of each letter in the subset of the remaining instances of the alphabet letters, the adjusted respective distribution weight being greater than a prior corresponding distribution weight.

2. The method of claim 1, further comprising:

prior to determining the losing player being the particular player:

adjusting the respective distribution weights of the alphabet letters based on the weighting rule;

allocating an instance of at least one further alphabet letter according to the adjusted distribution weights;

incorporating display of the instance of the at least one further alphabet letter into the display of the allocated instances of each alphabet letter in the game interface of the online game; and receiving from the particular player a further game action representing completion of a formation of a further word that includes the instance of the at least one further alphabet letter.

3. The method of claim 1, further comprising:

allocating an instance of a further letter to the player based on the distribution weight;

responsive to the allocation of the instance of the further letter, adjusting the distribution weight of the further letter according to the weighting rule; and allocating an additional instance of the further letter to the player based on the adjusted distribution weight; wherein the adjusted distribution weight is less than a prior distribution weight assigned to the further letter.

4. The method of claim 1, further comprising:

determining an occurrence relationship between a first letter and a second letter in a further word;

allocating to the player an instance of the first letter based on the assigned distribution weight;

responsive to the allocation of the instance of the first letter, adjusting the distribution weight of the second letter; and allocating to the player an instance of the second letter based on the adjusted distribution weight, wherein the adjusted distribution weight is greater than a prior distribution weight assigned to the second letter.

5. The method of claim 1, further comprising:

analyzing profile factors included in a user profile of the player;

determining a skill level of the player based on the profile factors; and adjusting the respective distribution weights of the alphabet letters based on the skill level of the player, wherein a profile factor is a game history and the adjusting the respective distribution weights includes increasing a distribution weight of high-point alphabet letters and decreasing a distribution weight of low-point alphabet letters when the skill level of the player is determined to be higher than a predetermined threshold, and wherein a high-point alphabet letter is relatively more difficult to use in word formations than a low-point alphabet letter.

6. The method of claim 1, further comprising:

receiving an indication of a promotional word being featured in a promotional campaign;

adjusting the respective distribution weight of each letter occurring within the promotional word; and allocating an instance of at least one letter of the each letter occurring within the promotional word based on the adjusted distribution weight, wherein, for each letter occurring within the promotional word, the adjusted distribution weight is greater than a prior distribution weight and an instance is allocated to one of the player and a further player.

7. The method of claim 1, further comprising:

analyzing a set of played words including all words having been played in a course of game actions in the game;

determining a prospective word formation being situated among the set of played words; and adjusting the distribution weight of a letter occurring within the prospective word formation, wherein the adjusted distribution weight of the letter is greater than a prior distribution weight assigned to the letter.

8. The method of claim 1, further comprising:

determining a word list including all words prospectively playable in a further game action;

analyzing a set of remaining letters available to the player in formation of a further word;

determining a number of words prospectively playable by the player in further game action utilizing the word list and the set of remaining letters; and reallocating at least one letter when the number of words prospectively playable by the player is less than a predetermined threshold.

9. The method of claim 1, further comprising:

receiving a vowel as a replacement letter into a letter tray corresponding to the player, the vowel producing a vowel-consonant ratio greater than a predetermined distribution ratio;

reallocating the replacement letter; and suspending the reallocation of the replacement letter when a consonant is received.

10. A non-transitory machine-readable storage medium embodying a set of instructions that, when executed by at least one processor, causes the at least one processor to perform operations comprising:

assigning to each alphabet letter a respective distribution weight according to a weighting rule of an online game, wherein each respective distribution weight reflects a frequency the corresponding alphabet letter, to which the respective distribution weight is assigned, is available for a game action in the online game of a game network server system;

allocating based on respective assigned distribution weights, for availability in one or more game actions by a particular player, instances of each alphabet letter in a plurality of the alphabet letters;

initiating display, to the particular player, of the allocated instances of each alphabet letter in a game interface of the online game;

receiving a game action representing completion of a formation of a word, the word based on selection of a subset of the allocated instances of each alphabet letter;

determining a losing player being the particular player having a point score in the online game lower than any further player within the online game, wherein each further player has a respective social network connection in a social network server system with the particular player;

based on determining the losing player being the particular player:

determining a number of remaining instances of the alphabet letters, available for distribution and yet to be allocated to the losing player, in accordance to the respective distribution weights and the plurality of alphabet letters previously allocated to the losing player;

determining the number of the remaining instances of the alphabet letters is less than or equal to a predetermined threshold;

comparing a set of played words based on one or more words previously formed in one or more game action selected by the losing player in the online game;

determining a prospective word formation, in a subset of the remaining instances of the alphabet letters, matches at least one of the words previously formed;

adjusting the respective distribution weight of each letter in the subset of the remaining instances of the alphabet letters, the adjusted respective distribution weight being greater than a prior corresponding distribution weight.

11. The non-transitory machine-readable storage medium of claim 10, the operations further comprising:

prior to determining the losing player being the particular player:

adjusting the respective distribution weights of the alphabet letters based on the weighting rule;

allocating an instance of at least one further alphabet letter according to the adjusted distribution weights;

incorporating display of the instance of the at least one further alphabet letter into the display of the allocated instances of each alphabet letter in the game interface of the online game; and receiving from the particular player a further game action representing completion of a formation of a further word-that includes the instance of the at least one further alphabet letter.

12. The machine-readable storage medium of claim 10, the operations further comprising:

allocating an instance of a further letter to the player based on the distribution weight;

responsive to the allocation of the instance of the further letter, adjusting the distribution weight of the further letter according to the weighting rule; and allocating an additional instance of the further letter to the player based on the adjusted distribution weight, wherein the adjusted distribution weight is less than a prior distribution weight assigned to the further letter.

13. The machine-readable storage medium of claim 10, the operations further comprising:

determining an occurrence relationship between a first letter and a second letter in a further word;

allocating to the player an instance of the first letter based on the assigned distribution weight;

responsive to the allocation of the instance of the first letter, adjusting the distribution weight of the second letter; and allocating to the player an instance of the second letter based on the adjusted distribution weight, wherein the adjusted distribution weight is greater than a prior distribution weight assigned to the second letter.

14. The machine-readable storage medium of claim 10, the operations further comprising:

analyzing profile factors included in a user profile of the player;

determining a skill level of the player based on the profile factors; and adjusting the respective distribution weights of the alphabet letters based on the skill level of the player, wherein the profile factor is a game history and the adjusting the respective distribution weights includes increasing a distribution weight of high-point alphabet letters and decreasing a distribution weight of low-point alphabet letters when the skill level of the player is determined to be higher than a predetermined threshold, and wherein a high-point alphabet letter is relatively more difficult to use in word formations than a low-point alphabet letter.

15. The machine-readable storage medium of claim 10, the operations further comprising:

receiving an indication of a promotional word being featured in a promotional campaign;

adjusting the respective distribution weight of each letter occurring within the promotional word; and allocating an instance of at least one letter of the each letter occurring within the promotional word based on the adjusted distribution weight, wherein, for each letter occurring within the promotional word, the adjusted distribution weight is greater than a prior distribution weight and an instance is allocated to one of the player and a further player.

16. The machine-readable storage medium of claim 10, the operations further comprising:

analyzing a set of played words including all words having been played in a course of game actions in the game;

determining a prospective word formation being situated among the set of played words; and adjusting the distribution weight of a letter occurring within the prospective word formation, wherein the adjusted distribution weight of the letter is greater than a prior distribution weight assigned to the letter.

17. The machine-readable storage medium of claim 10, the operations further comprising:

determining a word list including all words prospectively playable in a further game action;

analyzing a set of remaining letters available to the player in formation of a further word;

determining a number of words prospectively playable by the player in further game action utilizing the word list and the set of remaining letters; and reallocating at least one letter when the number of words prospectively playable by the player is less than a predetermined threshold.

* * * * *